United States Patent [19]

Buttner

[11] Patent Number: 4,655,976

[45] Date of Patent: Apr. 7, 1987

[54] CARBURETOR COMPONENTS AND CARBURETOR

[76] Inventor: Horace J. Buttner, 1501 Palos Verdes Dr. North, Harbor City, Calif. 90710

[21] Appl. No.: 258,172

[22] Filed: Apr. 27, 1981

Related U.S. Application Data

[63] Continuation of Ser. No. 17,667, Mar. 5, 1979, abandoned, which is a continuation of Ser. No. 865,078, Dec. 27, 1977, abandoned.

[51] Int. Cl.[4] ..... F02M 9/08

[52] U.S. Cl. ..... 261/44.2; 261/44 F; 261/65

[58] Field of Search ..... 261/44 F, 44 A, 65

[56] References Cited

U.S. PATENT DOCUMENTS

| | | | |
|---|---|---|---|
| 1,118,805 | 11/1914 | Reichenbach | 261/44 A |
| 1,131,312 | 3/1915 | Beamer et al. | 261/65 |
| 1,161,437 | 11/1915 | Beamer et al. | 261/65 |
| 1,407,024 | 2/1922 | Gilson | 261/65 |
| 1,450,762 | 4/1923 | Summers | 261/44 F |
| 1,461,847 | 7/1923 | Jackson | 261/65 |
| 1,462,641 | 7/1923 | Jackson et al. | 261/65 |
| 1,534,212 | 4/1925 | Hess | 261/44 A |
| 1,611,347 | 12/1926 | Hartwell | 261/44 A |
| 1,839,102 | 12/1931 | Kessel | 261/44 A |
| 2,024,638 | 12/1935 | Grace . | |
| 2,038,785 | 4/1936 | Gould | 261/44 F |
| 2,073,649 | 3/1937 | Price | 261/44 F |
| 2,214,273 | 9/1940 | Fish | 261/44 A |
| 2,236,595 | 4/1941 | Fish | 261/44 A |
| 2,264,347 | 12/1941 | Udale | 261/37 |
| 2,326,205 | 8/1943 | Dowdell | 261/18 R |
| 2,798,705 | 7/1957 | Lawrence, Sr. | 261/44 A |
| 3,100,236 | 8/1963 | Ott et al. | 261/72 R |
| 3,291,464 | 12/1966 | Hammerschmidt et al. | 261/44 A |
| 3,336,014 | 8/1967 | Shorrock | 261/44 F |
| 3,341,185 | 9/1967 | Kennedy, Sr. | 261/44 A |
| 3,752,451 | 8/1973 | Kendig | 261/50 A |
| 3,903,925 | 9/1975 | Perry | 261/44 A |
| 3,914,347 | 10/1975 | Kors et al. | 261/DIG. 39 |
| 3,920,778 | 11/1975 | De Rugeris | 261/65 |
| 3,969,445 | 7/1976 | Vogelsang | 261/44 F |
| 4,005,161 | 1/1977 | Shimo et al. | 261/52 |
| 4,046,844 | 9/1977 | Rickert | 261/DIG. 68 |
| 4,063,905 | 12/1977 | Johnson et al. | 261/44 A |
| 4,064,843 | 12/1977 | Holzbaur | 261/44 A |
| 4,064,847 | 12/1977 | Holzbaur et al. | 261/44 A |
| 4,065,526 | 12/1977 | Englert et al. | 261/78 R |
| 4,079,718 | 3/1978 | Holzbaur | 261/44 A |
| 4,099,505 | 7/1978 | Stumpp et al. | 261/44 A |
| 4,108,117 | 8/1978 | Stumpp et al. | 261/44 A |
| 4,108,128 | 8/1978 | Knapp | 261/44 A |
| 4,149,562 | 4/1979 | Johnson et al. | 261/44 A |
| 4,154,203 | 5/1979 | Peters et al. | 261/44 F |
| 4,191,716 | 3/1980 | Yamashita et al. | 261/390 |

FOREIGN PATENT DOCUMENTS

| | | | |
|---|---|---|---|
| 433083 | 8/1926 | Fed. Rep. of Germany | 261/65 |
| 1476148 | 3/1969 | Fed. Rep. of Germany . | |
| 637597 | 5/1928 | France | 261/44 A |
| 86769 | 7/1936 | Sweden | 261/44 F |
| 303564 | 11/1954 | Switzerland | 261/44 F |
| 2726 | of 1913 | United Kingdom | 261/44 F |
| 205411 | 11/1923 | United Kingdom | 261/44 F |

*Primary Examiner*—Tim Miles

*Attorney, Agent, or Firm*—Pollock, Vande Sande & Priddy

[57] ABSTRACT

An improved variable venturi carburetor including one or more improved features such as one or more air valve(s) comprising fuel discharge orifices, upstream of one or more throttle(s); backfire protection means in the air valve(s); layered construction of the air valve(s); overhead biasing means for the air valve(s), with or without related air valve(s) positioning means which may, for instance, assist in enrichment of the fuel air mixture during starting; an arm and ramp fuel metering arrangement interconnected, preferably directly, with an internal bore on a shaft which supports the air valve(s) means for rotation, through which the fuel may be directed from the pickup arm to the discharge orifices in or on the air valve means; ball valve means in the end of the pickup arm bearing against the ramp to assist in minimizing deviations in the fuel/discharge gap resulting from differential expansion; composite construction of the arm and ramp hanger of materials which coefficients of expansion selected to minimize gap changes resulting from temperature changes; various arrangements for fuel enrichment; improved throttle configurations; spatial configurations of shaft means for the air valve(s) and throttle(s) which facilitate provision of bearing structure for the aforesaid elements in the body of the carburetor while reducing the production of carburetor throat area taken up by the shafting arrangements; and other improvements.

56 Claims, 23 Drawing Figures

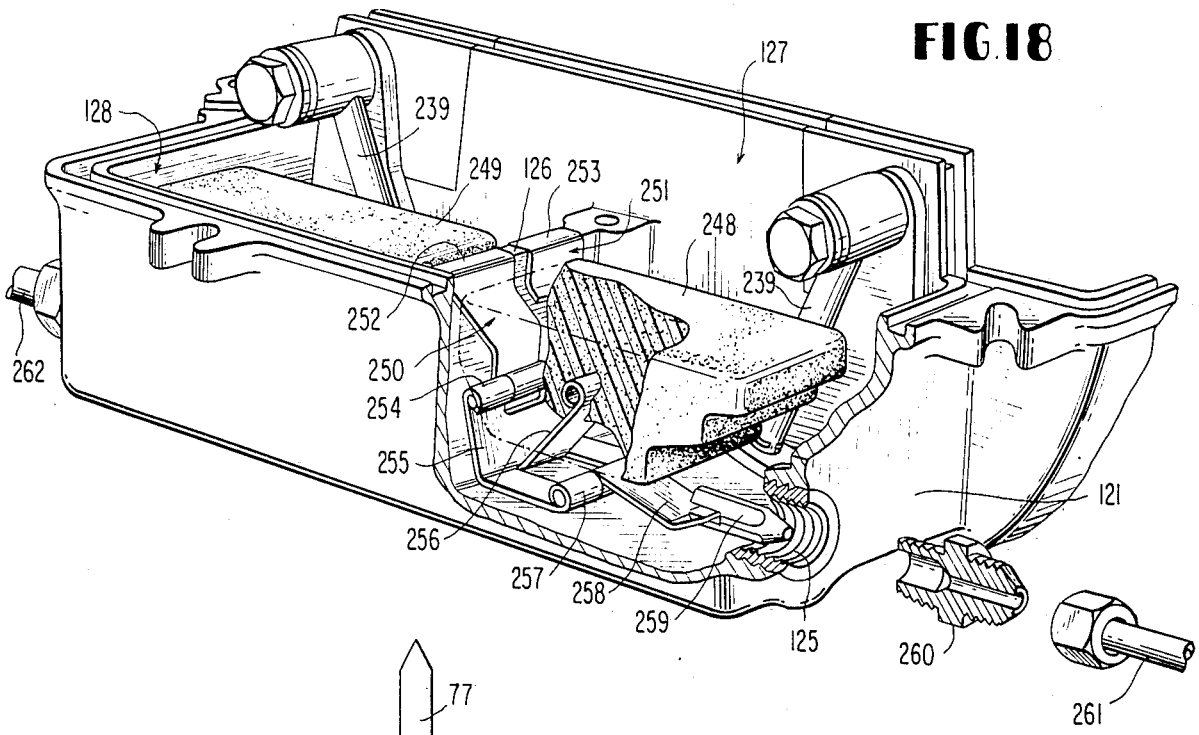
FIG. 18
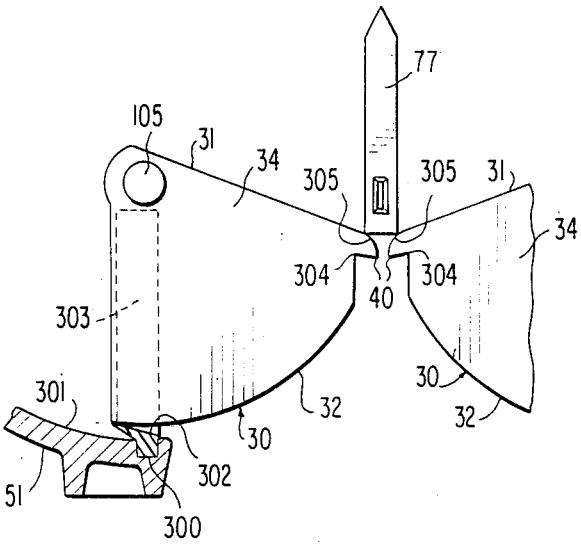
FIG. 19
FIG. 20
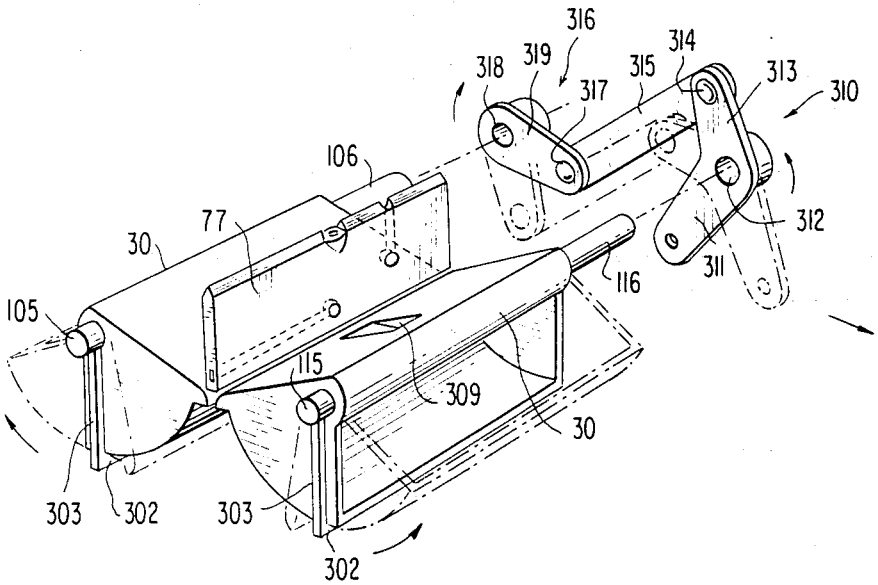

CARBURETOR COMPONENTS AND CARBURETOR

This is a continuation of application Ser. No. 017,667, filed Mar. 5, 1979, now abandoned, which is a continuation of Ser. No. 865,078, filed Dec. 27, 1977 (now abandoned).

BACKGROUND OF THE INVENTION

The present invention is directed to carburetor components and carburetors. More particularly, the invention is directed to carburetors capable of providing accurate mixture control, and of thoroughly atomizing fuel air mixtures, thereby leading to uniformity in the distribution of fuel and air to the cylinders of a multi cylinder engine.

It is known that when a piston engine is operated at fuel to air ratios leaner than stoichiometric, the levels of $NO_x$, HC and CO in the engine exhaust gases are reduced. Since $NO_x$, HC and CO are generally considered to be the most harmful components of automotive exhaust gases, operation at leaner than stochiometric mixture is a desireable objective from the standpoint of controlling pollution. Unfortunately, when piston engines are operated with fuel to air ratios leaner than stochiometric, such engines generally become considerably more sensitive to deviations from uniform distribution of fuel and air. Thus, when carbureted engines are adjusted for an overall fuel to air ratio substantially leaner than stochiometric, it has been found that some cylinders run leaner than others, some running sufficiently lean to cause misfiring of the engine.

The root of the problem is inadequate atomization and distribution of the fuel in the carburetor. A portion of the fuel, not successfully dispersed in the air passing through the carburetor, can follow various paths along the internal surfaces of the carburetor and being preferentially directed to certain of the cylinders and then to the other cylinders either at the same or different throttle settings. Thus some cylinders run at a richer mixture at the expense of others. The difficulties involved in solving this problem are illustrated by the tremendous number of different carburetor configurations which have been designed with the objective of obtaining more uniform fuel distribution. That the problem has not been satisfactorily solved is also shown by the extent to which the usual principles of carburetor design have been abandoned in recent attempts to solve the problem. A case in point is the "Dresserator" a venturi valve fuel/air mixing device which seeks to attain supersonic velocity in a throat of variable cross-sectional area, and to meter fuel into the throat in proportion to that area as it increases and decreases.

Viewed against the above background, the improved results provided by the present invention, including smooth engine operation with extremely low emissions, operation at leaner than stochiometric mixtures without misfiring but with optimum fuel economy, are surprising and unexpected. A test vehicle with a conventional engine and equipped with a carburetor in accordance with the invention has met the 1976 emissions requirements of both the United States Federal Government and the State of California without a catalytic converter or any other emission control devices.

SUMMARY OF THE INVENTION

The invention comprises an improved carburetor of the variable venturi type and individual carburetor components which are useful not only in variable venturi carburetors but also in carburetors generally.

The improved variable venturi carburetor of the present invention includes an induction passage having upstream air valve means and downstream throttle means therein, defining a fuel discharge zone therebetween. Multiple fuel discharge orifices positioned at the surface of said air valve means communicate with said zone. Biasing means bias said air valve means toward a normally closed position and position said air valve means at varying positions between its open and closed positions in response to respectively greater and lesser flows of air through said air valve means. Fuel metering means in communication with said discharge orifices is operable to deliver respectively greater and lesser quantities of fuel to said orifices in response to opening and closing of said air valve means.

When the fuel discharge orifices are positioned at the surface of the air valve, one can provide for coordinated movement of the orifices and the air valve, enabling one to consistently discharge the fuel into the region of highest air velocity. This is in contrast to known variable venturi carburetors having fixed fuel distribution bars in the zone between the air valve and the throttle valve, thus introducing fuel into a region which has relatively low flow velocity under certain conditions, such as for instance at idle and low throttle.

In accordance with a particularly preferred embodiment, a manifold is provided within the body of the air valve running along or adjacent a peripheral surface of the air valve past which the air passes. The discharge orifices may for example extend from this manifold through said peripheral surface at spaced positions along the surface. It is also beneficial and preferred that the orifices be distributed along a substantial portion of the length of the peripheral surface, so that it is introduced across much or all of the stream of air which rushes past the surface. Internal passages in the body of the valve member and a shaft on which the valve member is pivotally mounted conduct fuel from a source of metered fuel to the manifold.

In an air valve molded of plastic, which is a preferred material of construction, the valve member may be formed in two layers with all or a portion of the cross-section of the respective orifices, manifold and passages being formed in the relatively inward surface of one of said layers and the remaining portion of said cross-section, if any, being formed in the relatively inward surface of the other layer. This enables fabrication of the air valve without costly drilling operations and facilitates production of air valves with internal passages even when the valves are of curved or irregular cross-section.

In a multiple layer construction as above described, the criticality of achieving thorough sealing of the mating surfaces of the two layers along the internal air passages can be reduced by lining at least a portion of the internal passages with one or more tubular members. In one embodiment, such a tubular member may be joined to a lateral outlet opening in a hollow shaft about which the air valve pivots, the tubular member extending from the outlet opening through the passage formed in the valve member body towards the manifold.

When the fuel orifices are distributed at spaced intervals in the lip or peripheral surface of the air valve, it is preferable and beneficial that relatively shallow grooves be provided in said peripheral surface extending generally in the direction of air flow past the valve. The locally increased volumes of flow which stream past the lip at the locations of these grooves tend to thwart any tendency which may exist towards transverse variation of flow along the lip.

A groove formed relatively perpendicular to the direction of air flow across the lip and located adjacent to the lip in the upstream surface of the valve member can prove advantageous from the standpoints of increasing turbulence across the lip, performing an air gathering function for the grooves in the peripheral surface and/or providing a means for producing an additional pressure differential between the air passing the upper surface of the air valve member and the air between the air valve and the throttle.

It is known to protect air valves of variable venturi carburetors against backfire damage by providing apertures through the air valve body and a flexible flap on its upstream surface. The flap constitutes a form of check valve which remains closed during normal operation and opens to relieve internal pressure in the carburetor in the event of a backfire. The present carburetor may optionally include a valve member protected against backfire by a flap and a plurality of elongated generally parallel slots. These enable one to provide a large available open area when the flap is open, without requiring the flexible flap material to bridge across a wide gap, such as when the backfire protection involves large circular holes through the valve member. By eliminating the wide gap, the slots reduce or eliminate the tendency towards distortion and leaking of the flap engendered by wide gaps, and therefore tend to improve operation.

Irrespective of the shape of the backfire ports in the valve means, the flap can be advantageously secured thereto by a spring clip or clamp having a cross-section substantially in the shape of a "C".

For reasons explained below, it is sometimes desireable to use an air valve which is curved or bent when viewed in end elevation. When such a valve member is provided with backfire protection, it is advantageous if the flap is molded of flexible material having an undersurface conforming to the contour of the air valve upper surface.

The biasing means may be any suitable type of device capable of performing the above described biasing function, such as for instance a counter weight, pneumatic motor, torsion bar, spring or the like. Preferably, the biasing means extends from the upper surface of the air valve means to a support which is overhead the air valve member. Preferably the biasing means is an overhead spring means which may be connected to the air valve member either directly or indirectly through intermediate connecting means. According to a particularly preferred embodiment of the above described type, the connecting means may be a tension rod which is connected to a pivot on the air valve member. This pivot moves between two vertical planes as the air valve moves from closed to open position. The upper end of the tension rod is secured to a moveable overhead pivot, which is mounted and positioned on suitable supporting means so that it moves up and down in the space between said vertical planes. Preferably the lateral position of the overhead pivot is such that as the air valve member swings from closed to open position the said tension rod swings from a position in which it is inclined to the left of vertical, through vertical, to a position in which it is inclined to the right of vertical; alternatively, the tension rod may swing from right to left. In a particularly preferred embodiment the overhead pivot is supported on a moveable member mounted for reciprocation on a vertical post extending above the air valve member. The spring means may operate in compression or tension, and in the latter case may be connected between said moveable member and an overhead support.

An optional feature is an air valve positioning device to control the position to which the air valve member closes under the influence of the biasing means. In its idle position, the air valve is actually slightly open to perit the passage of an appropriate amount of air and fuel for engine idling. A choke is not essential with a carburetor of the type described herein. However, if a choke is not provided it is then convenient to provide for the air valve means to assume a fully closed position to provide full suction for starting. Thus, an air valve positioning device can be used to hold the air valve means slightly open when at idle and to cause said means to close fully when the engine is stopped or cranking. Such device cn also provide a definite stop for the air valve means so that it will close to the same idling position whether closed quickly (with large momentum) or slowly (with minimum momentum), thereby providing reproduceable fuel flow at idle.

A preferred form of air valve positioning device includes a withdrawable obstructing member. The latter is moveable between a first location in which it obstructs closing of the air valve beyond idle position and a second location to which the obstructing member is withdrawn so that the air valve can be more fully closed by the biasing means. The obstructing means may obstruct the air valve directly, such as by contacting the air valve member itself, or, preferably, indirectly, such as by contacting the biasing means, thus preventing the biasing means from closing the air valve member any further than idle. Manual or mechanized means may be provided for moving the obstructing member, such as a choke rod, spring and solenoid combination, penumatic motor or the like. A preferred example is a rolling diaphragm motor containing a spring which normally biases the obstructing member to its non-obstructing position and a rolling seal diaphragm vacuum motor, energized by a conduit which provides communication between the diaphragm and an area of reduced pressure in the carburetor throat, for moving the obstructing member into its obstructing position.

Any convenient fuel metering system may be employed, but the preferred system is the general category of pickup arm and metering ramp type of system an example of which is disclosed for instance in U.S. Pat. No. 3,752,451 to Kendig. The present invention provides a particularly preferred improved form of arm and ramp type fuel metering system which may be used in the carburetor of the invention and other carburetors.

A particularly preferred form of the present invention has an arm and ramp type fuel metering system, and provides a hollow shaft on which the air valve member pivots. This hollow shaft is inter-connected with the duct means in the air valve member and extends through the walls of the induction passage to a fuel chamber, within which the fuel arm is secured to the hollow shaft. A ramp of the known type located within the fuel chamber assists in controlling the flow of fuel from said chamber into a hollow bore in the arm and from thence through the hollow shaft to the fuel discharge orifices on the air valve means.

The present invention provides certain optional improvements which may also be employed. These include arm improvements and cam improvements. These may be used singly or in combination.

Arm and ramp type fuel metering systems have heretofore been criticized because of the machining expense involved in attaining adequate precision in the gap between the end of the fuel pickup arm and the contoured ramp. Departures of as little as 2/10,000ths of an inch from the predetermined gap can result in inaccurate mixture control at idle. In the present improvements the ramp contour tolerances are rendered much less critical by provision of a spring loaded close fitting ball valve in the bore at the end of the fuel arm. The ball makes rolling contact with the ramp and means are provided to confine the ball against lateral movement as the fuel arm moves between the idle and wide open position along the ramp. Thus, metering of fuel is achieved by movement of the ball relative to a metering edge of the bore, rather than by changing the gap between the arm and ramp.

As in the case of the arm improvement, the ramp improvements may be used in the present carburetor and others. The arm improvements enable one to minimize deviations in the arm/ramp gap resulting from differential expansion of the arm and ramp supporting structure. In the past, carburetors with arm/ramp fuel metering systems have had a common wall between the carburetor throat and fuel chamber, which wall extends from the ramp to the shaft which mounts the fuel arm. Unequal expansion of the arm and this wall can vary the gap between the arm and a ramp at different temperatures. To minimize such differences in expansion, the ramp may be supported by a hanger means which is carried on and suspended from the same shaft on which the fuel arm swings.

By selecting materials with suitable coefficients of expansion for the arm and ramp hanger, it is possible to produce desired changes in said gap and/or to minimize gap changes resulting from differences in temperature. For instance, to increase the fuel to air ratio when the engine and carburetor are cold and reduce said ratio when they are hot, one may select a fuel arm with a higher coefficient of expansion than the ramp hanger. For instance, the fuel arm may include both plastic and metal segments in series; or a longer fuel arm could be entirely of metal while the hanger was of a material having a substantially lower coefficient of expansion. A material with almost zero coefficient of expansion, such as Invar, could be used for the hanger, while steel or aluminum could be used for the arm. Any combination of materials which decreases the gap when hot and increases the gap when cold is suitable. Alternatively, one may select materials which tend to retain substantially the samp gap under both cold and hot conditions, and employ some other means to assist in engine starting, such as for instance the air valve positioning device described above or an enrichment device to be described below.

As indicated above, a common wall often divides the induction passage from the fuel chamber, and pulsation of the fuel/air mixture from the intake manifold back to the carburetor can transfer heat through this wall to the fuel ramp hanger. Assuming the hanger contacts the wall and that the fuel arm is spaced therefrom, their varying proximity to the wall causes a positive differential in temperature to develop in the ramp vis a vis the fuel arm as the engine warms up. This causes a progressive change in the arm/ramp gap. According to one of the improvements of the present invention, the ramp hanger is spaced inwardly in the fuel chamber from said wall, so that liquid fuel can circulate in said chamber between the wall and the hanger. Having been partially or completely withdrawn a sufficient distance from contact with the wall, the hanger can be maintained at substantially equal temperature with the arm by the circulating fuel.

Another optional feature of the invention is a fuel enrichment system which may be of assistance for starting. The preferred fuel enrichment system includes a conduit extending from a source of liquid fuel to a fuel enrichment port in the induction passage, said conduit being controlled by an on-off valve. The source of liquid fuel may for instance be the fuel in a fuel chamber which houses an arm and ramp fuel metering device and a conventional valve and float level controlling arrangement. The outlet port may for instance be in a wall of the induction passage, between the air valve means and throttle means, or in a flow divider within said passage, as described below.

A particularly preferred embodiment includes not only the above-mentioned on-off valve, but also a needle valve and throttling orifice in series with the source of fuel and fuel enrichment port to regulate the maximum flow of fuel to said port. In a particularly preferred embodiment, the conduit to the fuel enrichment port is vented when enrichment is not desired. Still more preferably, the on-off valve and needle valve are both mounted in a hollow cylindrical member, the above-mentioned orifice being formed in one end of said cylindrical member.

Irrespective of what form of on-off valve is used, the needle valve may, if desired, be formed of a synthetic resin or other material having a relatively high co-efficient of expansion, so that the needle and orifice combination are temperature responsive. At higher temperatures, when the needle has expanded longitudinally, the predetermined gap between the needle and orifice will thus be reduced, automatically decreasing the available amount of enrichment. Correspondingly, when the engine is cold and the needle valve has contracted, the gap between the needle and orifice will have been increased, increasing the amount of fuel available for enrichment.

The throttle used in the present invention may take a wide variety of forms; however, it is beneficial and preferred if the throttle member is positioned and shaped so that, whether the throttle is opened or closed the upper surface thereof is at a sufficient inclination to cause runoff of any liquid fuel which may be present thereon and to prevent accumulation and dumping of fuel. Eddy currents formed downstream of the air valve member tend to hold liquid fuel on the upstream surface portion of the throttle. The inclination should be sufficient to overcome the effect of these eddy currents either alone or in combination with other aids. For instance, an air leak, described in greater detail below, may exist between the air valve and throttle shaft bosses to facilitate removal of fuel from the upstream surface portion of the throttle member.

Certain benefits are obtained if the throttle member has an arcuate downstream surface portion, a substantial portion of which is at a uniform radial distance from the axis of rotation of the throttle member. This facilitates maintenance of a seal between said downstream surface portion and an adjoining portion of the carburetor body. When the throttle member has parallel ends which are perpendicular to the axis of rotation, this facilitates maintenance of a seal between said ends and the carburetor body. With the bottom being disposed radially relative to the throttle axis and the ends being disposed perpendicular thereto, sealing of both the bottom and ends relative to the body is facilitated, and it is particularly preferred that a continuous sealing member be disposed in sealing engagement with said ends, bottom and carburetor body. This is of particular benefit in a carburetor having a body molded of synthetic resinous matrial, in that a simple molded lip type seal can be positioned in a suitable groove in the body in sealing engagement with the ends and bottom of the throttle at the edge of the carburetor throat.

The throttle member may be hollow or of solid construction. When it includes an arcuate downstream surface portion as above described, it may have an open or closed back surface which is on one side of the above-mentioned seal, the upper surface, ends and radial lower surface all being joined together in air tight relationship on the opposite side of said seal. In general, it is preferred that the back surface have an area approximately equal to that of the upstream surface portion. Assuming the pressures on the upstream and back surfaces of the throttle member are substantially the same, the resultant forces tending to rotate the throttle member clockwise and counterclockwise clockwise will be substantially in balance. When the throttle member is hollow and its back surface is open, these pressure forces act upon the top and bottom of the member defining the upstream surface portion of the throttle member. When the back is open, it reduces the weight of the throttle member and facilitates its formation from synthetic resin by a molding process.

When the throttle member has an arcuate downstream surface portion as above described, it is beneficial to provide a lip at the intersection between the upstream and downstream surfaces. This lip may for instance comprise an interruption of the arcuate downstream surface portion which forms an undercut at that edge of the upstream surface portion past which the air flows. The presence of such lip is beneficial in disengaging from the throttle member any liquid fuel which may flow down its upstream surface portion so that such fuel does not flow down the arcuate downstream surface portion. If the downsteam surface portion is undercut beneath the lip so that the tip of the lip is substantially on or within the projected arc of the downstream surface portion, it is possible to avoid the unbalanced forces whih otherwise tend to open the throttle spontaneously. If the upstream edge of the lip is curved, this can be beneficial in reducing noise by reducing or eliminating pulsation and turbulence in the intake charge as it passes the edge of the throttle.

According to one optional but preferred variation of the invention, the air valve and throttle are mounted on shafts with the air valve shaft being outboard of the throttle shaft. Referring to a vertical reference line approximately in the center of the region through which the induction air flows with the air valve and throttle in the full open position, the air valve shaft is at a greater horizontal distance from said reference line than the throttle shaft. This provides a number of advantages. For example, it facilitates providing sufficient bearing structure for both the air valve and throttle shafts in the induction passage walls without out requiring the air valve shafts to be either elevated excessively above the throttle or located so far inboard that the air valves reduce the available throat area of the carburetor. Placing the throttle shaft inboard of the air valve shaft reduces the horizontal space required to house the throttle, thus enabling the horizontal dimensions of the carburetor body to be reduced. Moreover, with the throttles inboard of the air valve, there is less surface of the throttle valve exposed to backfire blasts, and therefore less effective force is exerted on the throttle shaft and the remainder of the structure. Less force is required to open the throttle against the differential between the metering suction and upstream pressure which exists behind the throttles. There is less deflection of the throttle shafts. If the air valve biasing means include lever arms (also called tension rods) as described above, there is a certain change in the angle between the tension rods and the upper surface of the air valve member as said member swings from closed to open position. This change in angle varies the force vector exerted on the air valve by the biasing means. When the air valve shaft is outboard of the throttle shaft, it permits one to provide the air valve member with a longer lever arm which in turn tends to reduce the change in angle described above.

From the foregoing it may be seen that the outboard arrangement of the air valve shaft positioning yields some advantages which may exist irrespective of the form of biasing means employed, while yielding a further advantage which results when the outboard air valve shaft feature is used in conjunction with the biasing means having the swinging tension rods and vertically reciprocating hanger. Thus, the outboard air valve shaft feature and swinging tension rod features may be used to advantage either alone or in combination.

When using outboard air valve shafts, it is beneficial to employ an air valve which, when viewed in side elevation, has a curved or bent shape so that the air valve reaches across the throttle shaft and down into the throat when the air valve and throttle are open. For instance, the air valve may have a gooseneck cross-section. This minimizes the space which must be provided between the downstream surface portion of the air valve and the upstream surface portion of the throttle when they are in the closed position and enables the air valve to lie flush on the upstream surface portion of the throttle when both are wide open, thus minimizing restriction of the throat.

Irrespective of whether one uses outboard air valve shaft mounting or not, it will often be convenient to form the air valve and throttle members of synthetic resin having bosses, i.e. areas of enlarged cross-section when viewed in end elevation, formed around their axes of rotation. These bosses may for instance, be formed around bores in the air valve and throttle, through which bores their respective shafts pass between opposite sides of the induction passage. In a preferred embodiment of the invention, the carburetor is provided with a boss on the throttle and a closely adjacent boss on the air valve, said bosses having a small clearance between them. This clearance is sufficiently small to direct the main flow of air around the tip of the air valve, rather than around the boss, but is of sufficient size to cause some air to pass around the boss and over the upstream surface portion of the throttle to purge fuel from said surface in a manner discussed above. If desired, one may provide a seal or seals on either or both of these bosses to close the above mentioned clearance. If desired, the seal may be arranged in such a manner as to move in or out of sealing engagement, depending on whether the engine is stopped or running. Thus, for example, the seal may be arranged on one of said bosses extending generally parallel to the axis of rotation and positioned so that the seal engages the opposing boss when the throttle and air valve are closed and disengages therefrom, to eliminate fricton, as the throttle and air valve open.

The above described air valve means and throttle means may each comprise one or more moveable valve members. For instance, the air valve means may be a single air valve member which performs its valving function in cooperation with an adjacent portion of the carburetor body. Similarly the air valve means may be a plurality of air valve members which perform their valving function either in cooperation with one another, or in cooperation with one or more adjacent portions of the carburetor body, or in simultaneous cooperation with one another and with one or more adjacent portions of the carburetor body. What is said above in respect to the air valve means is equally true of the throttle means.

In carburetors having plural air valve members or plural throttle valve members or both, it is advantageous to provide means for substantially synchronizing the movements of the several air valve members and the several throttle members. This may be accomplished for example, through the use of gearing, chain and sprocket or cable arrangements familiar to persons skilled in the art. Preferably, the synchronizing means in carburetors having plural air valve members is the biasing means. For example, when the biasing means includes a vertically reciprocating member and tension rods as described above, the upper pivot supports for the tension rods for each of the air valve members can be mounted on the same moveable member and therefore move in unison. According to a preferred embodiment, the synchronizing means for the throttle members is a rotation-reversing lever linkage comprising a lever on a first throttle shaft, a bell crank on a second throttle shaft and a connecting link so positioned that rotation of the bell crank in one direction causes opposite rotation of the lever. Such a linkage will not keep the throttles exactly in phase throughout their travel, but will work satisfactorily if set so that the throttles are in phase in the closed position.

In carburetors having plural air valve members and throttles, it is particularly preferred tha each throttle member and each air valve member be mounted for pivotal movement on its own individual shaft. Still more preferably, the respective shafts are located at the edges of and/or outside the envelope formed by upwardly projecting the outline of the induction passage outlet.

In a particularly preferred embodiment of the invention, the carburetor includes an induction passage which is sub-divided by a vertical dividing member into two adjoining throats. An air valve member and throttle member are provided for each throat, the respective air valve shafts, throttle shafts and divider being situated in parallel vertical planes.

An optional advantageous embodiment, applicable when there is a divider, is to extend the tips of the throttle valve members, when viewed in closed position, beneath and closely adjacent the lower edge of the divider. This has the advantage of tending to maintain axial flow even if the throttles do not open and close in exact synchronism. This configuration makes the adjustment of the linkage joining the two throttles less critical and tends to reduce or eliminate a suction feed back effect on the air valves which might otherwise exaggerate any different which might exist in the fuel flow through one air valve as compared to the other.

Another optional embodiment, applicable when there is a divider, and when there are separate air valve members provided in the throats on each side of the divider, is to provide each air valve member with its own separate fuel metering system. Then one has the option of introducing hydrocarbon fuel into both throats or introducing hydrocarbon fuel such as gasoline into one throat and alcohol into the other throat. The burning of alcohol in this manner may reduce the peak combustion temperature in the engine thus reducing or substantially eliminating $NO_x$ emissions.

Additional features of the invention may be found in the accompanying drawings and related Detailed Description of Preferred Embodiments set forth below.

BRIEF DESCRIPTION OF THE DRAWINGS

In the accompanying drawings:

FIG. 18 is an enlargement of that portion of FIG. 4 which includes the float chambers, to which has been added floats, float valves, fuel arms and fuel ramps.

FIG. 19 is a portion of FIG. 2 to which has been added a showing of sealing means for the ends of the throttle members.

FIG. 20 is a perspective view of the flow divider, throttle members, throttle seals, throttle shafts and throttle linkage employed in the carburetor of FIG. 3.

DESCRIPTION OF THE PREFERRED EMBODIMENTS

Figure 1:
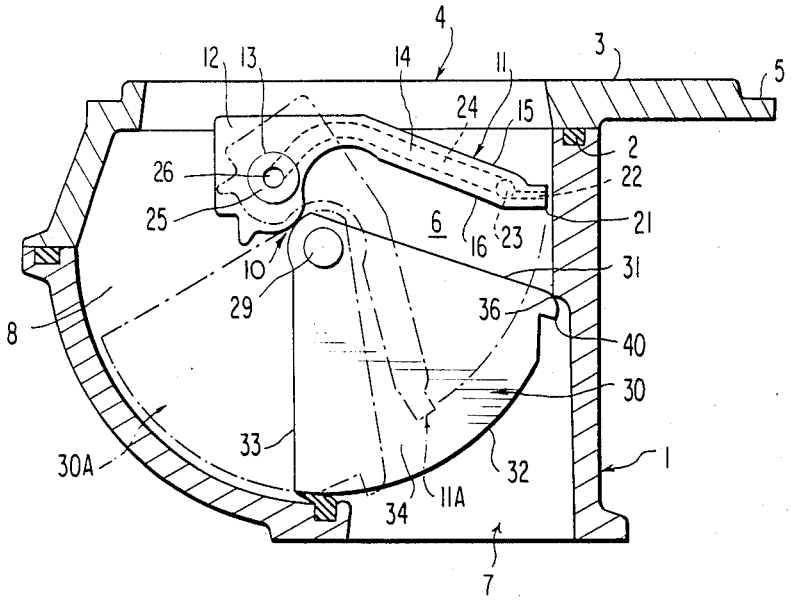
FIG.1 is a vertical section perpendicular to the axes of the air valve and throttle shafts of a single throat carburetor constructed in accordance with the invention.

FIG. 1 illustrates the internal construction of a carburetor in accordance with the invention. Such a carburetor may for instance include a body 1 having a cover 3 secured thereon with an intervening seal 2 to prevent air and fuel leakage. Cover 3 includes an inlet 4 and a flange 5, on which an air filter (not shown) may be mounted. Inlet 4 leads to an induction passage 6 which extends through body 1 to an outlet 7 connected to the engine manifold (not shown).

Within the upper portion of induction passage 6 is air valve 11 which may be of any convenient shape. However, it preferably has a boss 12 and integrally formed body portion comprising upstream and downstream surfaces 15 and 16, a first side 14, a second side (not shown), and a tip 21.

The air valve is provided with fuel discharge orifices and duct means to deliver fuel to the orifices. These orifices may for instance be in separate conduits secured to or adjacent the surface of the air valve, or may be formed integrally with the air valve. Integral orifices and ducts have the advantage that they may be located within the body of the air valve, such as for example, fuel discharge orifices 22 extending through tip 21. These in turn connect to manifold 23 and duct means 24, which are also within the body of the air valve.

The air valve is mounted on shaft means 25 received in a bore 13 extending through the air valve boss 12. This shaft is mounted in suitable bearing support means in the carburetor end wall 8 and in the opposite end wall (not shown). At least one end of air valve shaft 25 may extend through its respective end wall, and has a bore 26 within it to provide communication between an external source of metered fuel (not shown) and the duct means 24 in the body of the air valve.

A throttle shaft 29 is mounted in suitable bearing support means in the above mentioned carburetor end walls. A throttle of any convenient shape may be secured for rotation on said shaft. The throttle 30 is merely exemplary of a wide variety of throttle shapes which may be selected. Thus, for instance, the throttle 30 may include upstream, downstream and back surfaces 31, 32 and 33, first end surface 34 and a second end surface (not shown). If it is desired to provide a positive stop against which throttle 30 may close, the throttle lip 40 may engage a stop, such as for instance undercut 36 in the wall of body 1.

The carburetor will normally be mounted on the intake manifold of an internal combustion engine, such as for instance, a piston type automotive engine. Throttle shaft 29 will be connected to any suitable throttle control, such as for instance an accelerator pedal, hand throttle, automatic governor or other automatic control.

Figure 6:
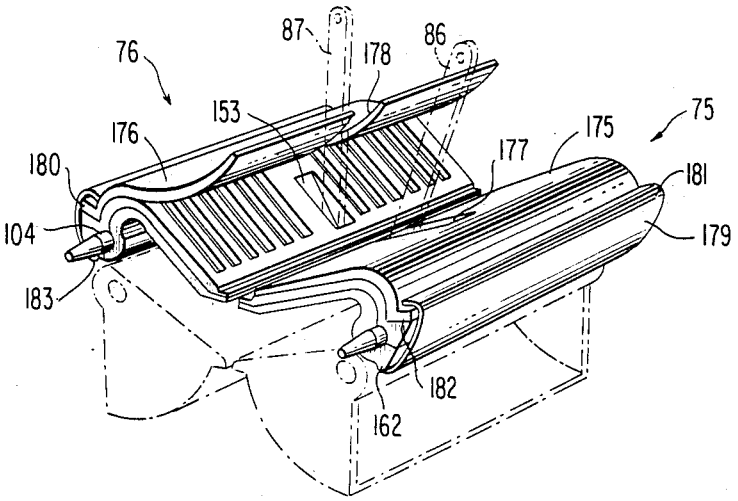
FIG. 6 is a perspective view of details of assembled air valves, with tension rods and throttles being shown in phantom outline.
Figure 10:
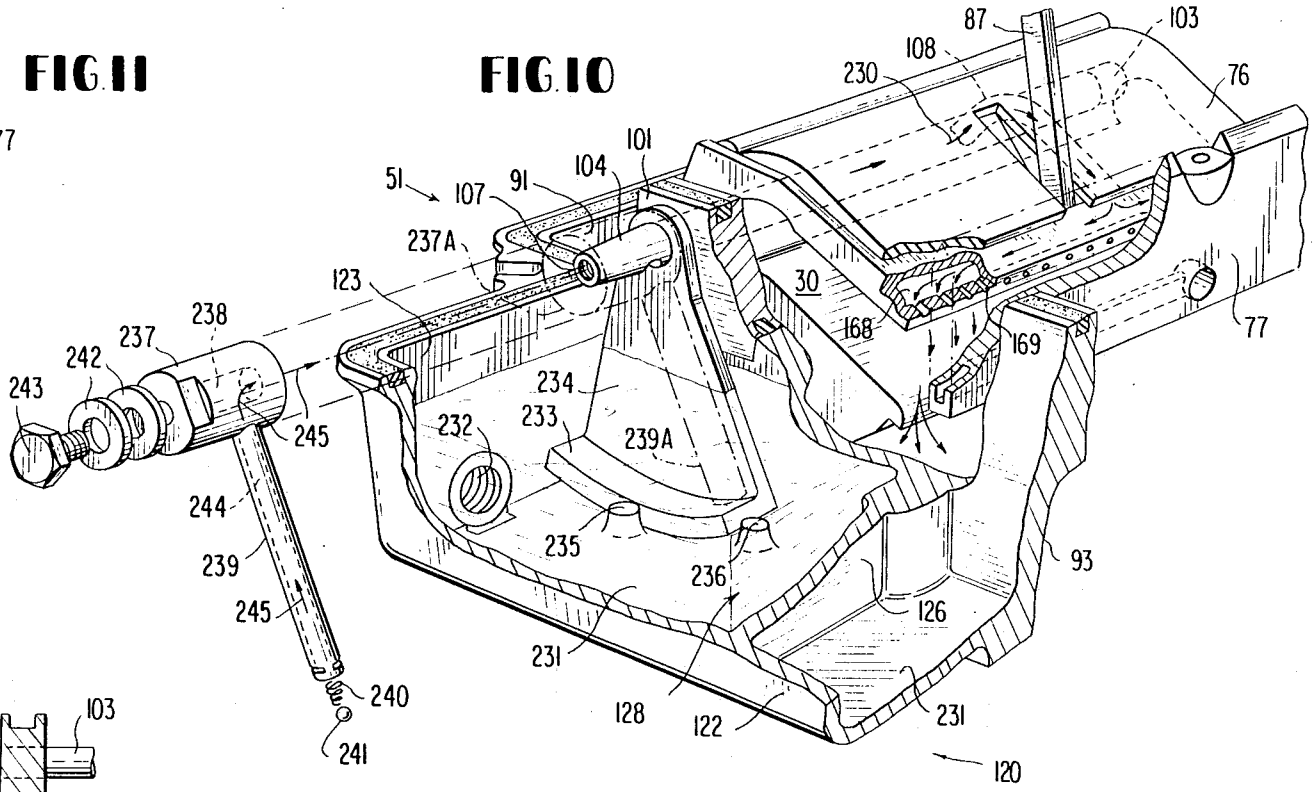
FIG. 10 is a broken out partially exploded portion of the perspective view in FIG. 3, showing details of the air valve member, the fuel metering system, and their interconnection.

The carburetor is provided with a boss on the throttle and a closely adjacent boss 12 on the air valve, said bosses having a small clearance 10 between them, defining thereby an air entry. The air valve 11 and throttle 30 are shown in their normally closed position. The downstream surface 16 of the air valve means 14 and the upstream surface portion 31 of the throttle means define between them a region of the induction passage 6. The length of the region measured in the general direction of flow through induction passage 6 is less than the width of said region measured parallel to the rotational axis of the air valve member 14, as shown in FIGS. 1, 6 and 10. With the engine running, rotation of throttle shaft 29 clockwise will open throttle 30 up to and including its fully open position 30A. Engine manifold suction on the air valve lower surface 16 will cause the air valve to open towards its full open position 11A against a closing force supplied by a biasing means (to be described hereinafter).

Metered fuel from the external source (not shown) passes through bore 26, duct means 24, manifold 23 and fuel discharge orifices 22 into the air which is drawn through induction passage 6 by engine suction. By virtue of the fact that the fuel discharge orifices are on the air valve, the fuel can be discharged into a fuel discharge zone in which the air is moving at high velocity, thereby facilitating atomization.

Figure 2:
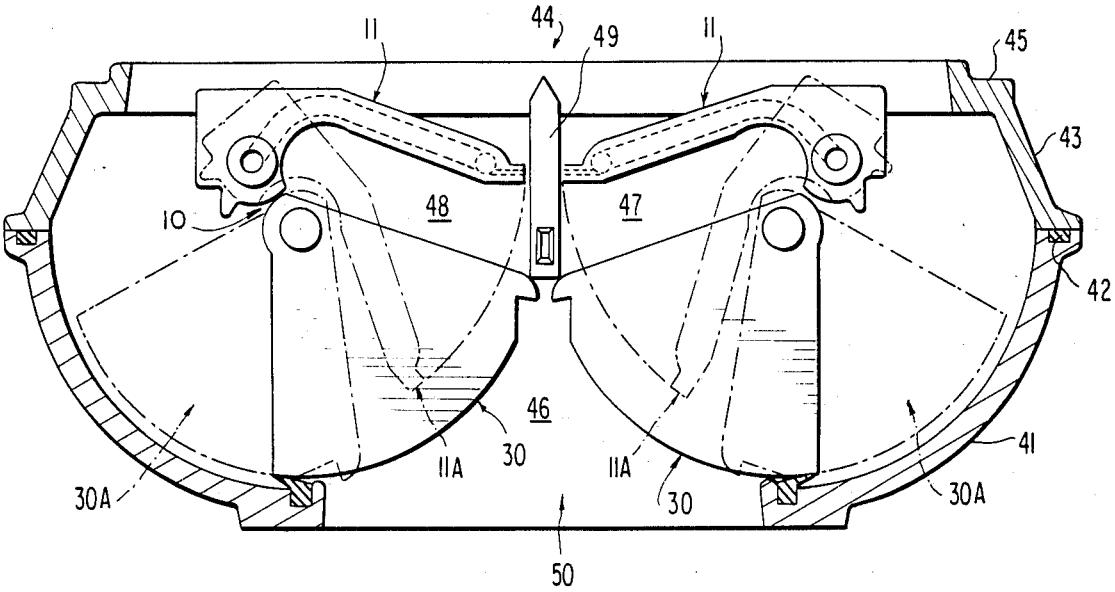
FIG. 2 is a vertical section perpendicular to the axes of the air valve and throttle shafts of a double throat carburetor constructed in accordance with the invention.

As shown in FIG. 2 the invention is readily adaptable to carburetors with multiple throttles and air valves. FIG. 2 discloses a carburetor having a body 41 to which cover 43 is secured in air and fuel tight relationship with the assistance of seal 42. Like the previous embodiment, this carburetor has an inlet 44 through upper body flange 45 on which an air filter (not shown) may be mounted. Induction air may pass from inlet 44 through induction passage 46, which is divided by divider 49 into a first throat 47 and second throat 48, past air valves 11 and throttles 30 as described in the above embodiment, and depart through outlet 50. If desired, persons skilled in the art will have no difficulty adapting the principles of the invention to carburetors having additional throats, air valves and throttles.

Figure 3:
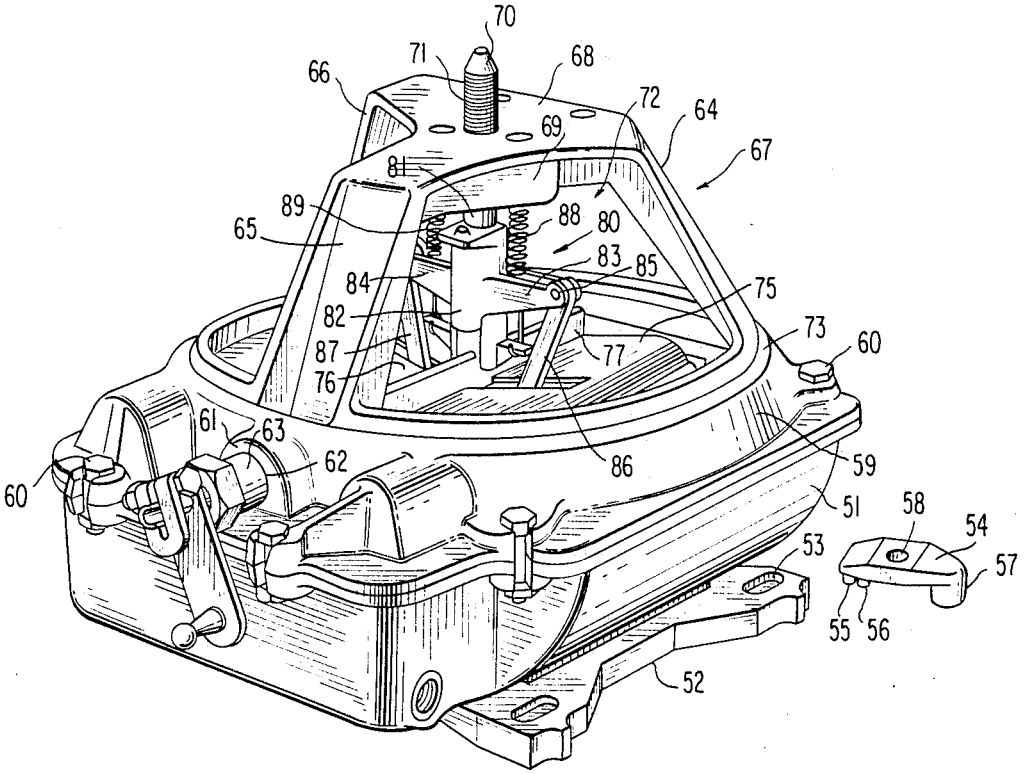
FIG. 3 is a perspective view of what is presently considered to be the best mode of practicing the invention.

The presently preferred embodiment of FIG. 3 can be fabricated of any convenient material, but many of its components, including body 51 and cover 59, are preferably formed of rigid, impact and heat resistance synthetic resinous material, such as for instance polyphenylene sulfide resin sold by Phillips Petroleum Company under the tradmark Ryton®, and designated as R-4. The body includes an integral or, preferably separate flange 52 for mounting the carburetor on the intake manifold of an engine in any suitable manner. The probability of damaging the carburetor flange by bending or overtightening may be reduced by using a fastening arrangement including a clamp 54. Clamp 54 includes a first foot 55 which engages the top surface of flange 52, a somewhat longer second foot 56 which extends into depression 53 but does not contact the bottom of the depression, and third foot 57 which contacts the machined surface of the manifold (not shown) which surrounds the carburetor. When a bolt (not shown) is inserted through hole 58 in the clamp and screwed into a threaded hole (not shown) in the manifold surface, the carburetor may be secured tight against the manifold surface without extering bending forces on the marginal edges of the flange 52. The clamping forces are exerted on the upper surface of the flange by the first foot 55 which is well inboard of the flange margins.

FIG. 3 shows the carburetor with its cover 59 bolted in place with bolts 60. A boss 61 and corresponding bore 62 formed in the cover serve as a mounting for the valve body 63 of a fuel enrichment system to be discussed below. Cover 59 also includes a bridge 67 having legs 64, 65 and 66 between which are openings 72 for the admission of induction air. Legs 64, 65 and 66, formed integrally of the same synthetic resinous material as the cover, extend upwardly and inwardly to join with a horizontal plate 68 beneath which is formed an integral slug 69. The latter serves as a mounting for a post 70 and various adjustment screws to be described hereinafter. Threads 71 on post 70 are provided for a fastening nut for an air filter (not shown) which will cover the plate 68, legs 64, 65 and 66 and seal against a ledge 73 beneath and adjacent the ends of the legs.

Visible through the openings 72 and cover 59 are first air valve 75, second air valve 76 and flow divider 77 and air valve biasing means 80. In this embodiment, a smooth portion 81 of post 70, extending from slug 69 downwardly to flow divider 77 is included in the air valve biasing means. A yoke 82 is mounted for vertical reciprocation on the aforementioned smooth portion 81. Yoke 82 includes first and second arms 83 and 84 which project outward over the air valves 75 and 76 and carry a first fulcrum 85 and second fulcrum (obscured by leg 65). Suspended from these fulcrums are first and second tension rods 86 and 87 connected with pivots (not shown) secured in depressions in the upstream surfaces of the air valves. First and second springs 88 and 89 suspended from slug 69 are tensioned to exert upwardly directed force on yoke 82, thus biasing air valves 75 and 76 upwardly towards their closed position.

Figure 4:
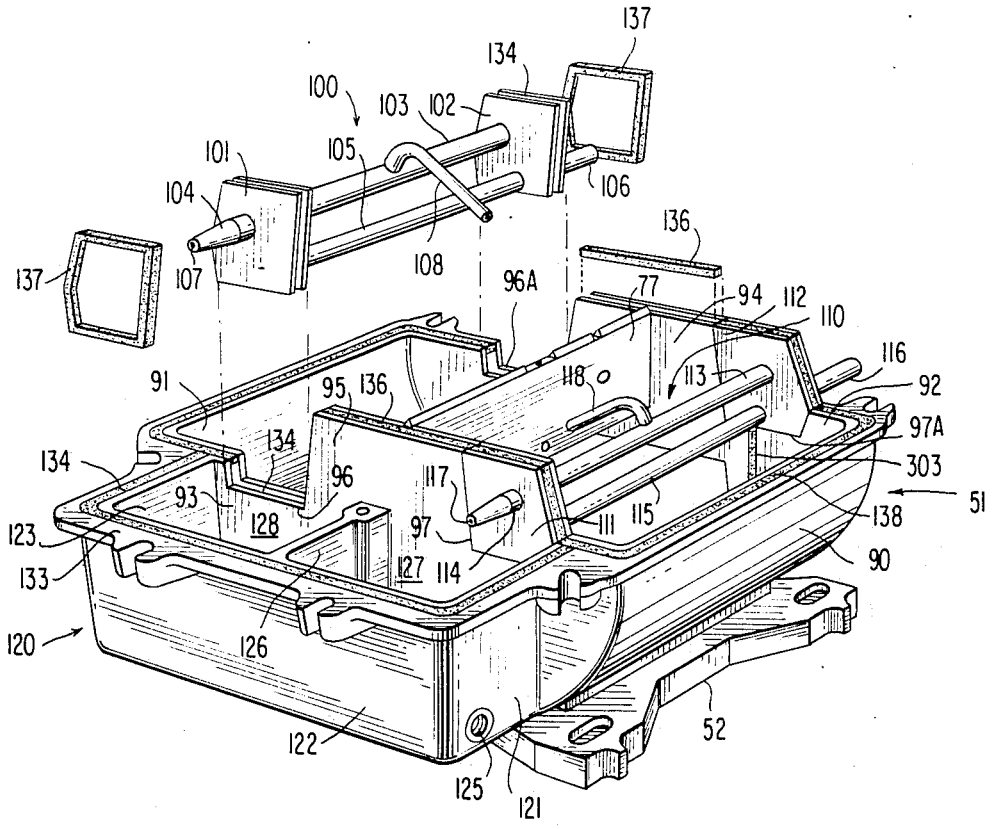
FIG.4 is a view of the body of the carburetor of FIG. 3 taken from the same perspective but with the cover, fuel metering system, air valves, air valve biasing means and throttles removed for clarity, and with a portion of the body broken out to show the construction and sealing of air valve and throttle shaft support sub-assemblies.

FIG. 4 shows the carburetor of FIG. 3 with the cover and other portions removed, exposing the interior of body 51. The carburetor body includes front wall 90 rear wall 91 and first and second end walls 92 and 93, the latter having respective upward projections 94 and 95. The throat divider 77 extends between these end walls.

First and second cutouts 96, 96A, 97 and 97A in upward projections 94 and 95 are provided to receive first and second shaft sub-assemblies 100 and 110. First shaft sub-assembly 100 includes shaft support inserts 101 and 102 at each end thereof, in which are rotatably mounted air valve shaft 103 and throttle shaft 105. Throttle shaft 105 includes a throttle shaft extension 106 which extends outwardly of insert 102, so that it projects outside the assembled carburetor. Air valve shaft 103 includes an extension 104 which projects outwardly of shaft support insert 101 and into the fuel chamber of the carburetor, as will be discussed below in connection with FIG. 10. Air valve shaft 103 includes a hollow bore 107 in communication with a laterally extending conduit 108 which extends into the interior of the air valve member, which will be explained in greater detail below in connection with FIGS. 5 and 6. The second shaft sub-assembly 110 includes shaft support inserts 111 and 112, air valve shaft 113, air valve shaft extension 114, bore 117, conduit 118, throttle shaft 115, and throttle shaft extension 116 which are identical to parts 101 and 108 described above.

The fuel chamber 120 is mounted on one end of the carburetor, and shares wall 93 with the carburetor throat. The remainder of the fuel chamber is formed by a front wall 121 end wall 122, rear wall 123 and a bottom wall (obscured behind end wall 122). A transverse dividing wall 126 extending between throat end wall 93 and fuel chamber end wall 122 divides the fuel chamber into a first chamber 127 and a second chamber 128. A threaded fuel inlet 125 is provided in front wall 121. The carburetor may be operated with a single float and float valve in first chamber 127, a fuel transfer aperture (not shown) being provided in dividing wall 126. On the other hand, if it is desired to operate the carburetor as a two float carburetor, such as for instance when supplying different fuels to each of the two chambers 127 and 128, the fuel transfer aperture is omitted and the chamber 128 is provided with its own threaded inlet (not shown) for the admission of fuel.

In order that there may be a fuel and air tight seal between the body 51, shaft sub-assemblies 100 and 110 and cover 59, the flange 133, end walls 92 and 93 and shaft sub-assemblies 100 and 110 are provided with grooves 134 along their edges. Seals 136, 137, and 138 in these grooves are clamped tightly when the cover 59 is secured to body 51.

Figure 5:
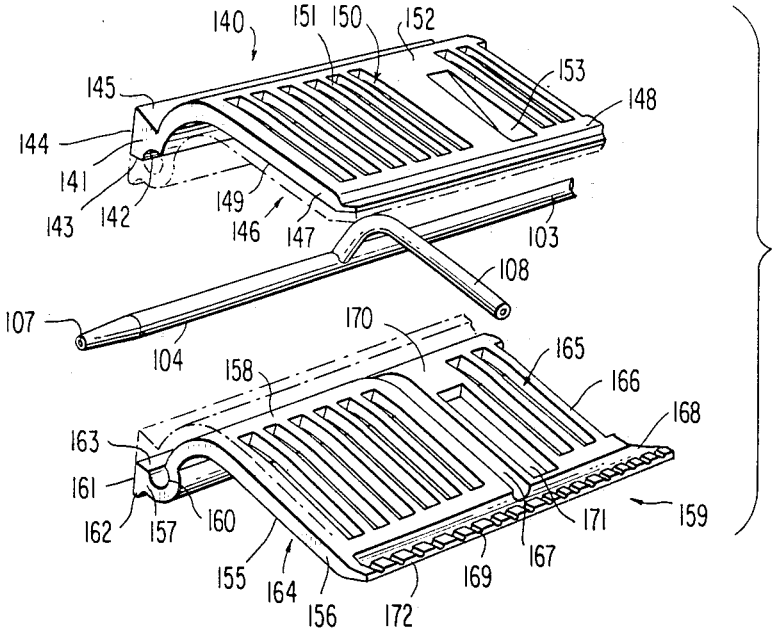
FIG. 5 is an exploded perspective view of one of the air valves of the carburetor shown in FIG. 3.

FIG. 5 illustrates the details of the air valves of the carburetor of FIG. 3. As shown in FIG. 5, the air valves may be fabricated in a plurality of layers, for instance upper and lower layers 140 and 159 shown in FIG. 5. The upper layer includes a boss portion 141, one lower surface of which constitutes a segment 142 of the bore for the air valve shaft. Boss portion 141 also includes a flat land corresponding in size and shape to a corresponding land 163 on the lower layer 159. Boss portion 141 also includes an upwardly and rearwardly diverging surface 145 which is useful for retaining a spring clamp as described below. Back surface 144 extends between land 143 and diverging surface 145.

Extending from boss portion 141 is a humped plate section 146 having a side 147 corresponding to one end of the air valve a top surface 148 corresponding to the upstream surface of the air valve and a bottom surface 149 which mates with the top surface 158 of lower layer 159. Distributed across humped plate 146 are alternating narrow bars 151 and slots 150, the latter passing all the way through the humped plate. A central portion 152 includes a depression 153 in which may be secured the lower pivot for a tension rod such as the tension rods 86 and 87 shown in FIGS. 3 and 6.

Lower layer 159 also includes a boss portion 157. It defines in part a segment 160 of the bore which surrounds the air valve shaft, such as for instance the air valve shaft 103 shown in FIGS. 4 through 6. At the intersection between the aforementioned segment and the back surface 161 of boss portion 157 is a rib 162. It is adapted to cooperate with diverging surface 145 on upper layer 140 for retaining a spring clamp in a manner to be described below.

Like the upper layer, lower layer 159 also includes a humped plate portion having a top surface 158, side 156 and bottom surface 155, the latter corresponding to the downstream surface of the assembled air valve.

Humped plate portion 164, like the corresponding portion of upper layer 140, includes elongated bars and slots 166 and 165 which are of the same size as the corresponding bars and slots 151 and 150 in upper layer 140. A central portion 170 of the lower layer includes an opening 171 of sufficient size to receive the depression 153. The opening 171, bars 166 and slots 165 are arranged to be in registry with the depression 153, bars 151 and slots 150 of the upper layer when the upper and lower layers are assembled with their side edges 147 and 156 in coplanar relationship.

A groove 167 extends through central portion 170 of lower layer 159 from the segment 160, which partially defines the air valve bore, to another groove 168, which is spaced inwardly from the tip 172 of the lower layer. Groove 167 defines a duct means extending generally perpendicular to the shaft bore and groove 168 defines a manifold extending generally parallel to the air valve shaft. Groove 168 extends along air valve tip 172 over a substantial portion, for example at least about half, of its length. At spaced points distributed over a substantial portion of the length of tips 172 are short grooves 169 extending perpendicular to grooves 168 and defining discharge orifices. It should be apparent that the grooves 167, 168 and 169 can be formed in top surface 158 of lower layer 159 or in bottom surface 149 of upper layer 140 or in both of said surfaces. Multi layer construction of the air valve makes it possible to form the duct means, manifold and discharge orifices from the above mentioned grooves and makes it possible to form the air valve means conveniently from synthetic resin material, including mineral or glass fiber reinforced synthetic resins, without drilling and with less complicated injection molds than would be required to form the orifices with withdrawable pins. Moreover the multilayer construction facilitates formation of a humped plate air valve with internal duct means which follows the contour of the humped plate.

The upper and lower layers 140 and 159 are intended to be assembled in surrounding relationship with an air valve shaft, such as shaft 103 of shaft sub-assembly in FIG. 4. The shaft is formed of an appropriate diameter to have a close fit in the bore formed between segments 142 and 160, and is of sufficient length to extend into the shaft support inserts 101 and 102 of FIG. 4 with the air valve shaft extension 104 protruding.

An optional but preferred embodiment includes securing a conduit 108 to shaft 103 with the conduit being in communication with the shaft bore 107. The conduit is preferably preshaped to nest within groove 167. When the upper and lower layers are assembled with shaft 103 and conduit 108 in place, the two layers are bonded to one another such as for instance by thermal, e.g. sonic welding.

In the completed air valve member the bottom surface 149 of upper layer 140 defines the upper surfaces of the duct means, manifold and discharge orifices defined by grooves 167, 168 and 169. Since it is desireable that the duct means, manifold and discharge orifices be substantially air tight, conduit 108 performs a useful function. Since it conducts fuel most of the way from the bore 107 to the groove 168 defining the manifold, it renders less critical the formation of an air tight joint between upper layer 140 and the sides of groove 167.

The bars 151, 166 and slots 150, 165 provide backfire protection for the assembled air valve. In order to close off the slots during normal operation, flexible flap members 175 and 176 are provided. They generally correspond in size to the upstream surfaces of the air valves, terminating a short distance inward from the air valve tip 21, as more clearly shown in FIG. 7. In order that they will not interfere with the operation of tension rods 87 and 86, flaps 175 and 176 are provided with cutouts 177 and 178, leaving the depressions 153 uncovered even when the flap is in the down or closed position as illustrated by flap 175 in FIG. 6.

Flaps 175 and 176 are secured to their respective air valves by spring clamps 179 and 180, which grip the back edges of the flaps with their upper arms, such as back edge 182 and clamp upper arm 181 on flap 175 and spring clamp 179 in FIG. 6. Rib 162 on the boss portion 157 of lower layer 159 serves as a catch for the lower arms of the clamps, such as for instance lower arm 183 of clamp 180 in FIG. 6.

Figure 7:
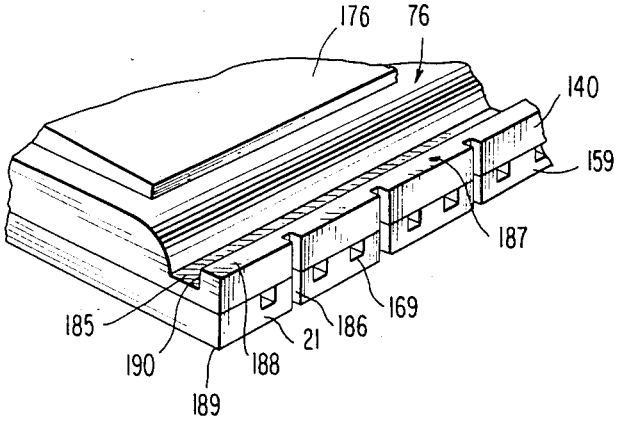
FIG. 7 is an enlarged portion of one of the air valves shown in FIG. 6.

FIG. 7 discloses the grooves which may be provided in or adjacent the tip or peripheral surface of the air valve, perpendicular and/or parallel to the direction of air flow. FIG. 7 discloses a corner of an air valve 176 formed of upper and lower layers 140 and 159 as shown in FIGS. 5 and 6. The air valve includes a tip or peripheral surface 21 through which extend the fuel discharge orifices formed by grooves 169 in lower layer 159. Grooves 186 extend generally parallel to the direction of air flow through peripheral surface 21, cutting through its upper and lower surfaces 188 and 189. These grooves are of assistance in inhibiting the shifting of fuel transversely along the peripheral surface under any unstable conditions causing transient motion of air flow transversely to normal flow and along the tip 21.

A groove 185 may be formed relatively perpendicular to the direction of air flow extending along and adjacent peripheral surface 21 in the upstream surface of air valve 76. Such groove can prove advantageous from the standpoint of increasing the turbulence across the tip or peripheral surface 21 and for producing an additional pressure differential between the air valve and throttle in the inducation passage of the carburetor. If the grooves 186 are made deeper so that they cut through the back surface 190 of raised edge 187, groove 185 can then perform an air gathering function for the grooves 186.

Figure 9:
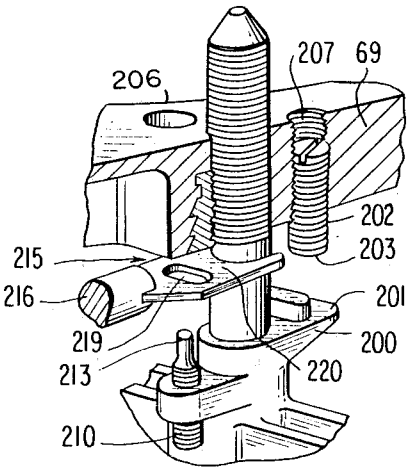
FIG. 9 is a partial section taken along section line 9—9 of FIG. 8.
Figure 8:
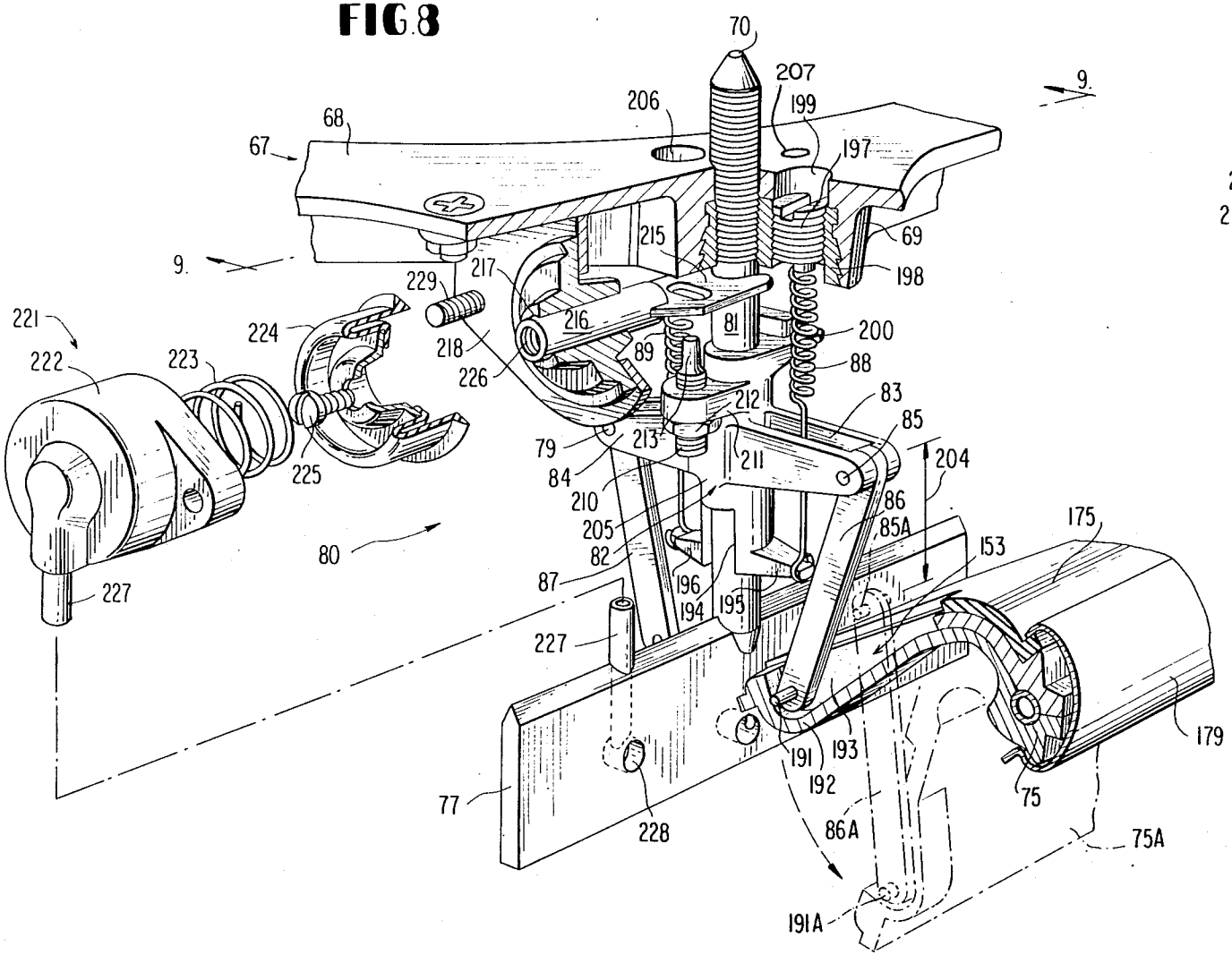
FIG. 8 is a broken out and enlarged portion of the cover, air valve and air valve biasing means of the carburetor of FIG. 3, also showing details of an optional air valve positioning device.

FIGS. 8 and 9 disclose additional details of the air valve biasing means 80 previously discussed in connection with FIG. 3, and additional details thereof, as well as an optional air valve positioning device. FIG. 8 shows the post 70 and its smooth portion 81, yoke 82, first and second arms 83 and 84, first fulcrum 85, first and second tension rods 86 and 87, and first and second springs 88 and 89 depicted in FIG. 3. However, FIG. 8 also shows the second fulcrum 79 which was obscured in FIG. 3. Inasmuch as much of cover 59 and all of the carburetor body 51 (with the exception of flow divider 77) have been removed, and since the one air valve shown in FIG. 8 has been sectioned intermediate its ends perpendicular to its axis of rotation, it is possible to see clearly in FIG. 8 the details of depression 153 (FIGS. 5 and 6) and the lower pivot for tension rod 86.

As shown in FIG. 8 the depression 153 comprises a first side wall 193, a similarly shaped parallel second side wall (not shown) and a lower wall 192 which follows the bottom contours of the two side walls and joins them together in air tight relationship so that the interior of depression 153, which opens into the upstream surface of the air valve, is pneumatically isolated from the downstream surface thereof. A short pin 191 fixedly secured in the side walls of depression 153 serves as the lower pivot for tension rod 86.

In FIG. 8, air valve 75 is shown in a nearly closed position. Opening of the throttle to increase the suction beneath air valve 75 causes it to pivot towards its fully open position, indicated by phantom outline 75A. As air valve 75 moves towards position 75A the side walls of depression 153 exert downward and outward force on tension rod 86, moving it towards its fully extended position 86A. In the process, tension rod 86 swings from a downward inclination to the left of vertical, to a downward inclination to the right of vertical. This is because the fulcrum 85 is maintained between the two vertical planes occupied by lower pivot 191 when it is in the air valve closed position and in the fully open position indicated by phantom outline 191A.

Movement of fulcrum 85 to its full open position 85A is indicated by arrow 204. The lateral position of fulcrum 85 is fixed in this embodiment by arm 83, which is bifurcated. Similarly arm 84 governs the lateral position of fulcrum 79. Arms 83 and 84 extend laterally from the cylindrical body 205 of yoke 82, which is provided with a yoke slot 194 at its lower end so that it may when in fully depressed position telescope over the upper edge of flow divider 77.

At the lower end of yoke body 205 are first and second spring ears 195 and 196, to which are secured the lower ends of springs 88 and 89 respectively. The upper end of spring 88 is secured to the underside of adjusting screw 197 engaged in a threaded insert 198 secured in slug 69. Adjusting screw 197 is accessible for adjustment through the top plate 68 of bridge 67 through a bore 199. Although not essential, there may be a similar adjusting screw (not shown) in bore 206 attached to the upper end of spring 89. Based on the foregoing, it should be apparent that the biasing means 80 biases the air valve 175 towards its closed position, and that the yoke 82 reciprocates or moves between upward and downward positions respectively as the air valve 175 closes and opens.

In order to provide a positive stop for the yoke and air valves, a stop arm 200 extends laterally from the yoke body 205, said arm being partly visible in FIG. 8 and more fully visible in FIG. 9, from which spring 88 and its adjusting screw have been removed. Stop arm 200 has an upper suface 201 which is aligned with the lower end 203 of adjusting screw 202 which is positioned in a threaded bore 207 located in slug 69 of bridge 67. Adjusting screw 202 provides a positive stop for yoke 82, and therefore for the air valves, which stop can be adjusted by turning the screw.

FIGS. 8 and 9 also disclose details of an optional air valve positioning device including a withdrawable obstructing means. The latter may for instance prevent the biasing means from closing the air valve member any further than its idle position when the engine is operating, but causes the air valve means to close fully to develop maximum suction on the fuel while cranking and starting. For example, the obstruction means may cooperate with an idle adjustment screw 210 threadably engaged parallel to the longitudinal axis of yoke body 205 in a lateral projection 211, said screw being held in position by lock nut 212 and having an upper screw end 213 for engaging the obstruction means.

The obstruction means may comprise a withdrawable obstructing member such as spade 215 comprising an axial extension of a rod 216. The latter is mounted for horizontal reciprocation in a bore 217 carried on a partition 218 dependent from bridge plate 68. Spade member 215, which also appears in FIG. 9, includes an aperture 219 and a barrier or obstructing portion 220 which can be alternately positioned above the upper screw end 213 of idle adjustment screw 210 by horizontal reciprocation of rod 216.

When spade 215 is in the position shown in FIGS. 8 and 9, upper screw end 213 of idle adjustment screw 210 can pass through aperture 219 as the stop arm 200 rises to meet the lower end 203 of adjusting screw 202. Assuming the spade is in this position when the engine is stopped, the biasing means 80 can close the air valves to their fully closed position to develop maximum fuel suction for starting. When the engine has been started and is running, a somewhat more open position of the air valves is desireable for idling. Consequently, when the engine is running the spade 215 can be withdrawn slightly by right to left movement so that the spade flat portion 220 is directly above upper end 213 of the idle adjustment screw. Thus, spade 215 then obstructs the biasing means from closing the air valves beyond idling position.

Rod 216 and attached spade 215 may be moved in and out of its biasing means obstructing position manually or by motor means, such as a solenoid, diaphragm motor or the like. Where motor means is used it may be manually or automatically controlled. An example of the latter is shown in FIG. 8.

For example, one may use a vacuum motor 221 which is shown exploded in the figure, but is normally mounted against partition 218 and held in place by studs, such as stud 229 and a cooperating nut (not shown). Within the vacuum motor housing 222 is a spring 223 which normally urges rolling diaphragm 224 to the right. The diaphragm is secured by a suitable screw 225 to a threaded bore 226 in rod 216.

When the engine is stopped, the spring means 223 normally urges diaphragm 224, rod 216 and spade 215 to the extended position shown in FIGS. 8 and 9. The motor 221 is arranged to withdraw spade 215 to a position in which flat portion 220 is in the closing path of idle screw 210 when the engine is running. This is accomplished by a conduit 227 which connects the interior of housing 222 and the left side of rolling diaphragm 224 to a suitable source of vacuum, e.g. metering suction, such as port 228 in flow divider 77 within the induction passage of the carburetor. The spring tension and diaphragm area are calibrated to keep the spade 215 in extended position until the engine has started, whereupon the diaphragm will urge rod 216 and spade 215 to the left. Thus, as soon as the air valves open, the flat portion of the spade will be positioned above the upper end of the idle adjustment screw, preventing the air valves from closing past idle position.

FIG. 10 illustrates combined portions of the preceding figures. In it can be seen the second air valve 76, second tension rod 87 and flow divider 77 of FIG. 3. FIG. 10 also shows elements of the carburetor body 51 shown in FIG. 4, including second end wall 93, shaft support insert 101 and rear wall 91, along with elements of fuel chamber 120 including end wall 122, rear wall 123 and dividing wall 126, defining in part the second float chamber 128. FIG. 10 also discloses threaded inlet 232 in rear wall 123 of float chamber 128. Some of the details of air valve 76 which have been shown in exploded form in FIG. 5 are shown in assembled form in FIG. 10, including the assembled combination of air valve 76 with air valve shaft 103, shaft extension 104, shaft bore 107, conduit 108 and grooves 168 and 169 defining the manifold and discharge orifices.

By means of arrows 230, FIG. 10 illustrates the communication of the air valve shaft bore 107 through conduit 108 with the manifold and discharge orifices defined by grooves 168 and 169. FIG. 10 also provides orientation between the items described above and the fuel metering system and shows the fuel arm in exploded relationship relative to air valve shaft 103.

Although the present invention may employ any convenient fuel metering system, the arm and ramp type is preferred. In the present embodiment the fuel arm assembly includes a banjo fitting 237 having an internal bore 238 adapted to fit in sealing engagement on the end of air valve shaft extension 104. A bolt 243 extending through washers 242, banjo fitting bore 238 and internal threads in the air valve shaft bore 107 draw the banjo fitting into the position of outline 237A.

The fuel arm assembly also includes fuel arm 239 having an internal bore 244 which communicates, as indicated by arrows 245, with the banjo fitting bore 238 and air valve shaft bore 107. With the fuel arm assembly in place on air valve shaft extension 104, the fuel arm occupies the position of dashed outline 239A.

Bore 244 of fuel arm 239 may be of any desired configuration but preferably partially encloses a ball valve 241 which is urged outwardly by spring 240. Ball 241 engages the contoured upper surface of fuel ramp 233 suspended from air valve shaft 103 by a fuel ramp hanger 234.

The fuel ramp is held in position with the assistance of side and end positioning protuberances 235 and 236. These respectively engage the side and end of fuel ramp 233 and are formed in the fuel chamber floor 231.

The surface of fuel ramp 233 has a contour which varies in distance from the arc described by the radial extremity of the fuel arm as it pivots on air valve shaft 103. This varying contour varies the gap between the ramp and the end of the fuel arm, causing the ball 241 to reciprocate in bore 244 and meter varying quantities of fuel through the bore 244, bore 238 bore 107, conduit 108, and groove or manifold 168, varying the quantity of fuel discharged through orifices 169 as shown in FIGS. 10 and 11.

Figure 11:
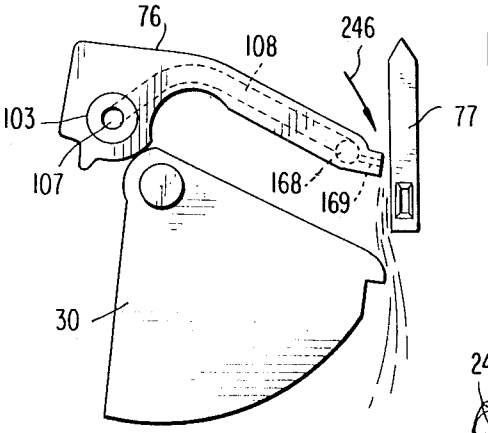
FIG. 11 corresponds to a portion of FIG. 2, and shows an air valve and throttle moved to the positions which they occupy at idle.

The fuel mixes with induction air indicated by arrow 246 in FIG. 11 and rushes past throttle 30 to the carburetor outlet (not shown). As throttle 30 is moved by linkage connected to an accelerator or other control means, the throttle varies the metering suction exerted on the downstream side of air valve 76. This causes the air valve to open and close against the action of the biasing means 80 as described above. This in turn rotates the shaft 103 and fuel arm 239, thereby varying the quantity of fuel which is introduced into the carburetor induction passage by the air valve means.

Figure 12:
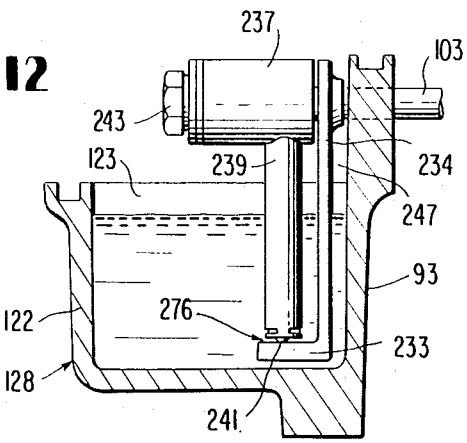
FIG. 12 is a view, partly in section, showing the fuel arm, ramp and hanger of FIG. 10.

FIG. 12 illustrates the desireable feature of suspending fuel ramp 233 from air valve shaft 103 by hanger 234. When hanger 234 is laterally spaced from induction passage wall 93 by spacing 247, it facilitates keeping the hanger and fuel arm 239 at the same temperature. For reasons explained above this tends to promote more accurate metering of fuel. FIG. 12 also illustrates the above described gap 276 between the end of fuel arm 239 and upper contoured surface of fuel ramp 233.

Figure 13:
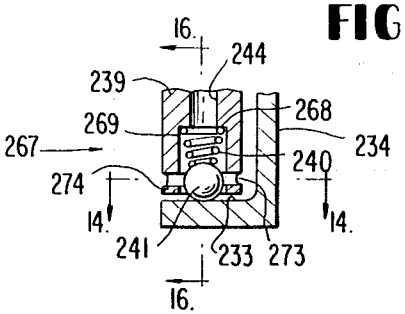
FIG. 13 is an enlarged portion of FIG. 12, shown in cross-section.

FIG. 13 is a partial enlargement and section of FIG. 12 showing fuel ramp 233, the lower end of hanger 234, the lower end 267 of fuel arm 239 and bore 244. In the lower end of bore 244 is an enlarged bore 269. The transition between bores 244 and 269 is a shoulder 268 against which rests one end of the spring 240. The opposite end of the spring bears on ball 241. A plurality of grooves 273 are cut through the lateral surface of the fuel arm adjacent an equatorial portion of ball 241.

Figure 14:
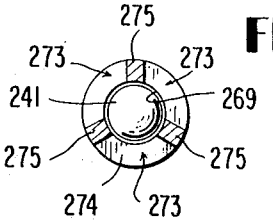
FIG. 14 is a sectional view taken along section line 14—14 in FIG. 13.

As shown in FIG. 14, the grooves 273 are cut in such a manner as to extend from the outer surface of the fuel arm through the wall thereof so as to open into the bore 269. Several fuel arm wall segments 275 are left in place. These segments provide attachment between the remainder of the fuel arm and a disc of material 274 which remains below segments 275. Disc 274 retains the ball against lateral movement relative to the vertical axis of enlarged bore 269. If ball 241 has a very small clearance from the inner walls of enlarged bore 269, such as for instance the minimum clearance required to permit reciprocation of the ball, it is then desireable that the total cross-sectional area of intersections between grooves 273 and bores 269 be sufficient to pass the amount of fuel required for full throttle operation.

It should be noted that the grooves 273 may be replaced by other kinds of structure capable of providing a path to bring fuel from the exterior of the arm to a metering edge adjacent an equatorial portion of ball 241 within the fuel arm. This function can be performed not only by the apertures resembling grooves as depicted in the figures, but also by apertures of differing shape. Moreover, if the walls of the fuel arm are sufficiently thick, the apertures may penetrate the end of the arm instead of extending through the peripheral surface thereof. In such case the requisite apertures can penetrate the end of the fuel arm.

Figure 15:
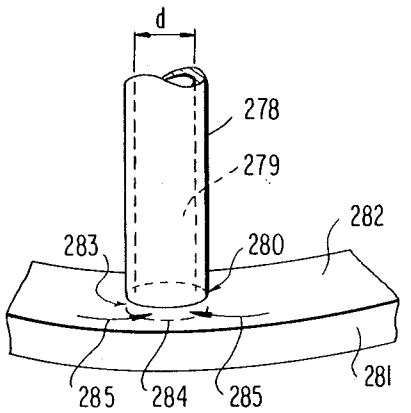
FIG. 15 is a diagrammatic perspective view of a conventional arm and ramp fuel metering system.

FIG. 15 illustrates a prior art fuel arm which may be used with the invention, instead of the ball-equipped fuel arm described above. Fuel arm 278 of FIG. 15 includes an internal bore 279 and a lower end 280 adapted to traverse the upper surface 282 of fuel ramp 281. A gap 283 is present between fuel arm lower end 280 and fuel ramp upper surface 282. The flow of fuel across the ramp upper surface 282 and under the lower end of the fuel arm into bore 279 is represented by arrows 285. The rate of flow is governed by a number of variables including the cross-sectional area available for flow. Since the ramp surface is designed to be close enough to the end of the fuel arm so that the cross-sectional area available for fuel flow is less than the cross-sectional area of bore 279 (at least at idle and low power), the available cross-sectional area, indicated by dotted outline 284, will then be a function of the diameter "d" of the fuel arm bore 279 and the height "h" of gap 283, according to the equation: $A=3.14dh$.

In conventional fuel arms and ramps such as are depicted in FIG. 15, gap 283 may be measured in thousandths or ten-thousandths of an inch at idle. Accurate fuel metering is quite important for many internal combustion engine applications, and small inaccuracies in the lift or contour of the ramp can very substantially impair fuel metering accuracy. In practice it has been found that deviations of as little as two-ten thousandths of an inch from design tolerances can be troublesome. The effect of such deviations on the available cross-sectional area for the flow of fuel can be calculated according to the formula given in the preceding paragraph, by substituting "y", the deviation in ramp contour, for "h". Then, the equation becomes A=3.14dy.

When a ball is provided in the fuel arm in accordance with one preferred embodiment of the present invention, the available cross-sectional area for fuel flow is rendered considerably less sensitive to deviations in ramp contour. This is illustrated in part by FIG. 16, which is a much enlarged sectional view taken on section line 16—16 of FIG. 13, with the spring 240 omitted. The view shows the positions of the ramp 233 and ball 241 relative to the extreme lower end of fuel arm 239.

Assume for purposes of discussion that the parts are in the positions as shown, and deviate from manufacturing specifications. More specifically, let us assume that the dotted line 290 represents the intended position of the fuel ramp upper surface relative to the end of arm 239. Then, "y" may be considered to represent the deviation from the ramp contour specification. As indicated previously, the equation A=3.14dy will provide the error in flow area and fuel metering accuracy for a prior art fuel arm. However, with the improved arm and ramp combination shown in FIG. 16, it can be shown that the error in cross-sectional area resulting from a given value of "y", is less than 3.14dy.

Figure 16:
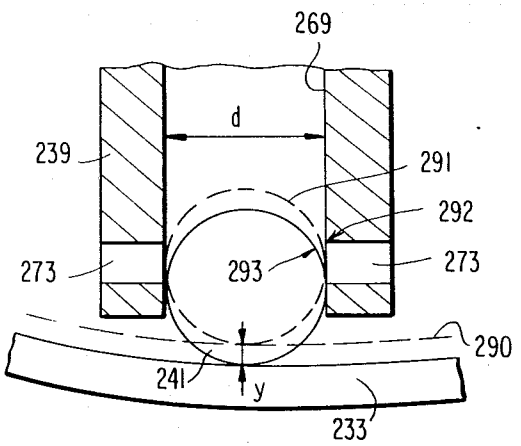
FIG. 16 is a diagrammatic view of an improved arm and ramp fuel metering system in accordance with the present invention, demonstrating the principle of operation of the embodiment disclosed in FIGS. 10, 12, 13 and 14.

In the improved fuel arm of FIG. 16 there are metering edges 292 formed by the intersections of bore 269 and grooves 273. Metering of fuel takes place between metering edge 292 and the closest point of ball 241 represented by arrow 293. Because the surface of the ball moves obliquely relative to metering edge 292, a given deviation "y" will produce a relatively smaller change in the distance between metering edge 292 and the opposing portion 293 of ball 241. This relatively smaller change in spacing between the ball and metering edge results in a relatively smaller amount of error in the cross-sectional area available for metering fuel.

Figure 17:
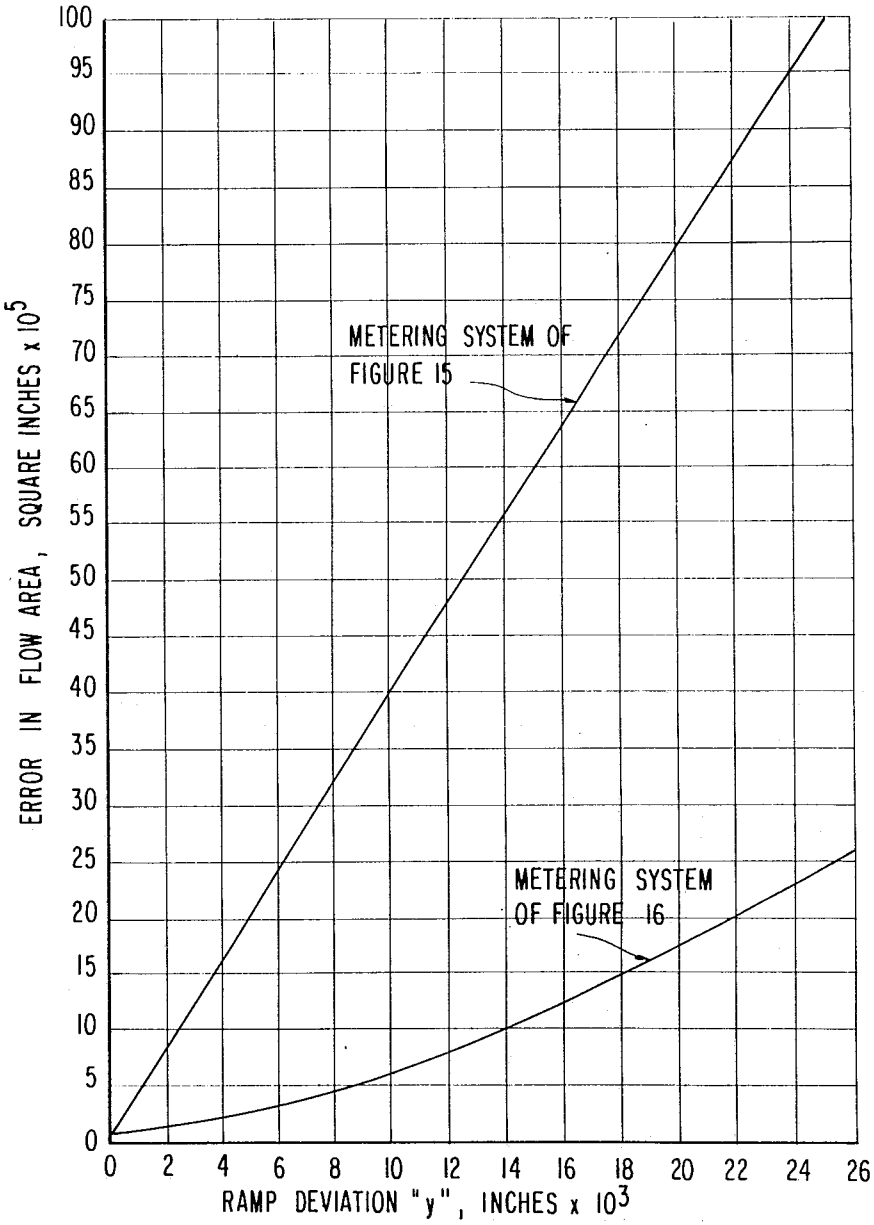
FIG. 17 is a graph illustrating how the arm and ramp fuel metering systems of FIGS. 15 and 16 differ in sensitivity to deviations in ramp dimensions.

The foregoing is illustrated by the graph in FIG. 17, which compares the error in flow area produced in the arm/ramp combination of FIGS. 15 and 16 with varying amounts of ramp deviation "y". In each case it is assumed that the bore of the fuel arm is 0.125 inches. In the graph, ramp deviation "y" is expressed in inches$\times 10^3$ in a range from 0 to 26. The error in flow area is expressed in square inches$\times 10^5$ in a range from 0 to 100. Where, for instance, the deviation "y" is 8, the error in flow area of the conventional system may be more than six times as great as that of the improved metering system. Thus, the present invention considerably reduces the sensitivity of the fuel arm/ramp combination to ramp contour tolerances. Therefore, one can obtain quite acceptable fuel metering accuracy with less stringent ramp contour tolerances. Alternately, one can obtain more accurate fuel metering with the improvements of the present invention as compared to conventional arm/ramp fuel metering systems, assuming both are manufactured to the same tolerances.

FIG. 18 discloses details of the preferred system for controlling the level of fuel in the float chambers. The figure shows first and second floats 248 and 249 suspended in float chambers 127 and 128 by first and second float hangers 250 and 251. These hangers both include saddle portions 252 and 253 respectively, which extend over the upper edge of fuel chamber dividing wall 126. When the fuel chamber cover is fastened on, its lower surface tightly clamps the saddle members against the dividing wall. The construction of the first and second hangers and connected valving mechanism is identical; thus only the first hanger is fully shown in the drawings.

As shown in FIG. 18, float hanger 250 includes a hinge 254 from which is suspended a float arm 255, including an upwardly extending float mount 256. A pivot 257 at the end of float arm 255 is connected with valve actuating lever 258, which in turn engages valve member 259. The latter cooperates with a valve seat 260 which is normally threaded into the threaded inlet 125 in fuel chamber front wall 121 and includes a threaded end to which may be secured a fuel line 261. A similar arrangement of parts is provided in float chamber 128 to connect with a second fuel line 262.

The floats may be of any suitable material, such as for instance an expanded closed cell synthetic resin. The floats and float valves operate in a conventional manner maintaining an adequate level of fuel which may be delivered to the air valve means by fuel arms 239.

FIG. 19 discloses details of preferred embodiments of the throttles. A portion of the carburetor body 51 is shown to include a groove 300 running generally parallel to the axis of rotation of throttle shaft 105. This groove contains a seal 302 which contacts arcuate downstream surface portion 32 of throttle 30 in such a manner as to prevent leakage of air from a position adjacent the carburetor body bottom surface 301 into the induction passage. When the throttle ends 304 are flat and perpendicular to the axis of rotation of shaft 105, as is preferred, the seal 302 can include integral extensions 303 which continue up both ends 34 of each throttle. Such extensions may for example extend to a position adjacent throttle shaft 105. Such an extension 303 may also be seen in FIG. 4 beneath shaft 115 in end wall 92, and in FIG. 20.

As shown in FIG. 19, the preferred throttles 30 both include lips 40 at the intersections of their upstream and downstream surface portions 31 and 32. These lips are formed by undercuts 304 in the downstream surface portions 32 so that the extremities of the lips are substantially on the projected area of the lower surfaces. When the throttle lips have rounded upper edges 305, as viewed in transverse cross-section, this tends to reduce or eliminate pulsation and turbulence in the intake charge as it passes the edge of the throttle.

FIG. 20 shows that the throttles 30 may include depressions 309 to receive the protruding lower wall 192 and side walls of depressions 153 on the air valves (see air valve 75 in FIG. 8) when the air valves and throttles are in the fully open position.

The throttles of FIG. 20 are mounted on the throttle shafts 105 and 115 of FIG. 4, having throttle shaft extension 106 and 116 respectively. In order to provide counter-rotation of the throttles about said shafts, the shaft extensions are fitted with levers and a reversing link. These include a bell crank 310 which is installed on throttle shaft extension 116. The bell crank has a lower arm 311, which may for instance be connected to accelerator pedal linkage, a central bore 312 to receive the throttle shaft extension 116, an upper arm 313 and a pivot 314 in the upper arm. The lever 316 has a bore 318 to receive the throttle shaft extension 106, and an arm 319 having pivot 317 at its outer end. Reversing link 315 has its ends connected to pivots 314 and 317. Arrows in FIG. 20 illustrate movement of bell crank lower arm 311 to the right, which causes the throttle shafts to turn in opposite directions, opening the throttle.

Figure 21:
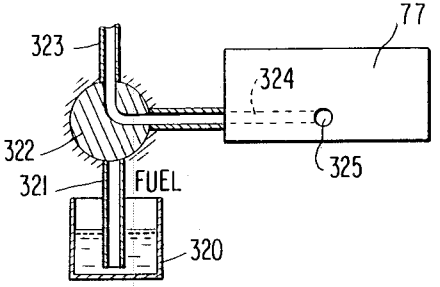
FIG. 21 is a schematic diagram of a fuel enrichment system.

FIG. 21 illustrates a fuel enrichment system which is useable for starting purposes. It includes a fuel enrichment port 325 in flow divider 77 (see FIG. 10) in the induction passage of the carburetor. This port is in communication through passage 324 with a valve 322 which is capable of placing the port 325 in communication with a vent 323 (as shown) or, on rotation of the valve, with a conduit 321 extending to any suitable source of fuel 320, such as for instance one of the float chambers of the carburetor. A more detailed embodiment of the foregoing is disclosed in FIG. 22.

Figure 22:
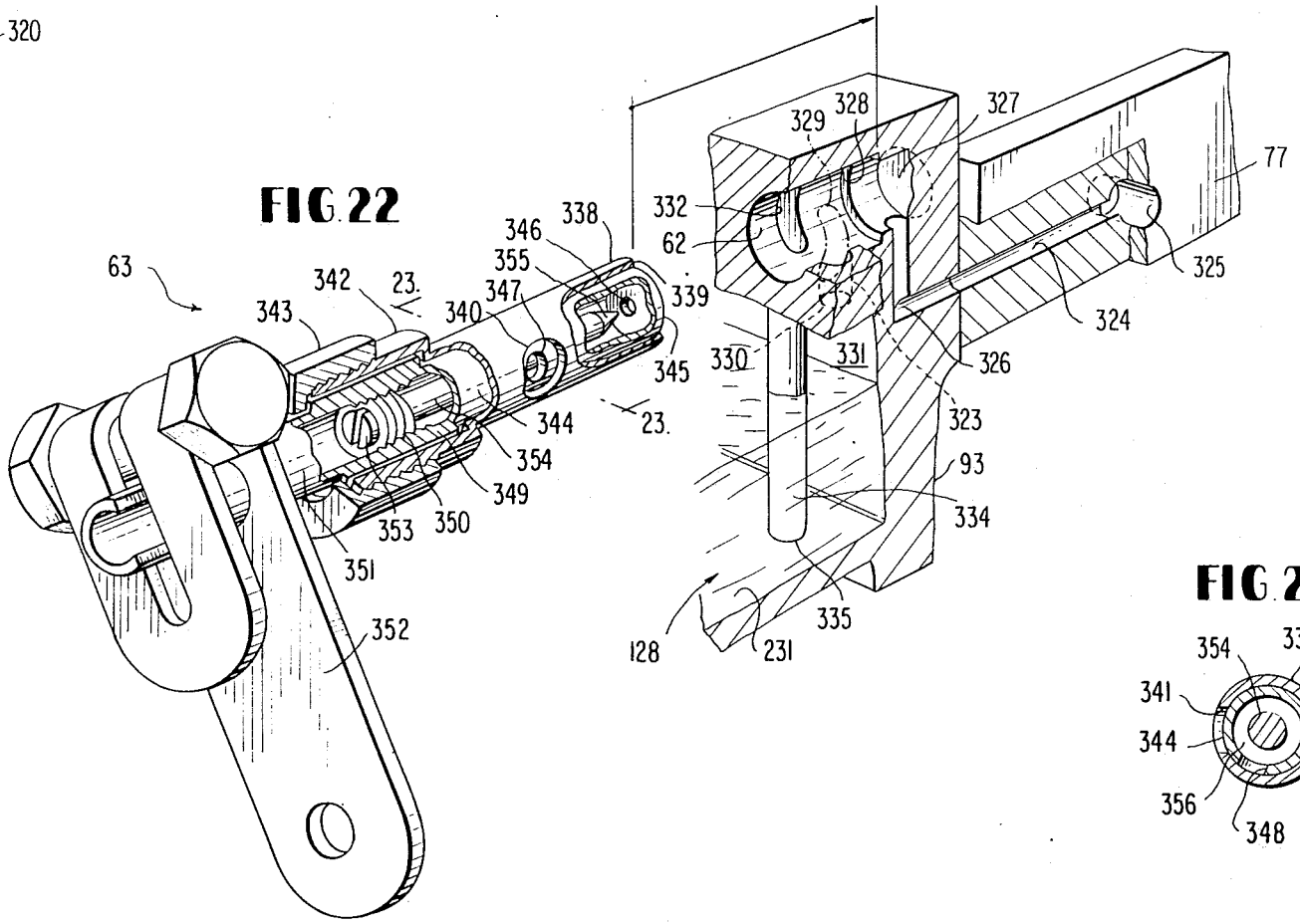
FIG. 22 is a broken out portion, partially exploded, of the fuel enrichment system of the carburetor of FIG. 3.

The fuel enrichment system shown in FIG. 22 includes the flow divider 77 and elements of the carburetor body end wall 93 and float chamber 128 whose floor 231 is partly visible. Fuel enrichment port 325 in divider 77 is connected via passageway 324 in the divider and passageway 326 in wall 93 with a pocket 327 formed at the end of fuel enrichment valve bore 62 (see FIG. 3). The transition between bore 62 and the smaller diameter pocket 327 forms a shoulder 328 perpendicular to the bore axis.

Within bore 62 is a vent port 329 which is shown in dotted outline. Facing vent port 329 across bore 62 is a similarly shaped port 332 referred to as the fuel port. Vent port 329 is connected by a short conduit 323 to an opening 330 in free communication with the gas space 331 above the liquid level in float chamber 127, fuel chamber dividing wall 126 (see FIG. 18) having been omitted from FIG. 22 to expose the conduit 334, described below.

Fuel port 332 communicates with a conduit 334 which extends into the fuel in float chamber 128. The bottom end 335 of pipe 334 is spaced a short distance above the float chamber floor 231 in order that fuel may be drawn into conduit 334.

Figure 23:
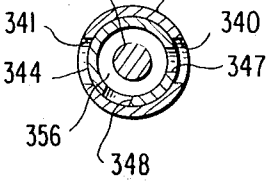
FIG. 23 is a sectional view along section line 23—23 of FIG. 22.

The fuel enrichment valve body 63 includes a cylindrical barrel portion 338 which is designed to fit snugly into bore 62 with its open end 339 engaging the shoulder 328. In the peripheral surface of the barrel are a first port 340 and a second port 341 (FIG. 23) which are held in registry with vent port 329 and fuel port 332 respectively. Valve body 63 also includes an enlarged casing section 342 externally threaded to receive a centrally apertured axial retainer nut 343.

Nut 343 retains hollow valve member 344 which includes a throttling orifice 346 at its otherwise closed inner end 345. In the peripheral wall portions of hollow valve member 344 are the first and second ports 347 and 348 (FIG. 23) which are selectively brought into registry with ports 340 and 341 when an extension 351 on valve member 344 is turned by actuating lever 352. An enlarged boss 349 thereon maintains the axial position of valve member 344. Threads 350 within boss 349 engage the head of needle valve 353. The needle valve shank 354 extends through valve member 344 past the ports 347 and 348 so that its point or valving surface 355 is presented to throttling orifice 346. However, the shank 354 is of an appropriate diameter to provide an annular space 356 between the shank and that inner surface of valve member 344.

When the fuel enrichment valve is in the position shown in FIG. 22 the valve is open to the gas space 331. Suction applied by engine vacuum at the port 325 draws air and/or fuel vapors through openings 330, conduit 323, ports 329, 340 and 347, annular passage 356, throttling orifice 346, pocket 327, passages 326 and 324 and port 325 into the induction air passage. Rotation of actuator 325 60° clockwise rotates ports 340 and 347 out of registry, disconnecting fuel enrichment port 325 from gas space 331. Simultaneously, the ports 341 and 348 are brought into registry. Accordingly, suction applied at fuel enrichment port 325 then draws fuel from float chamber 128 through conduit 334, ports 332, 341 and 348, annular space 356, orifice 346, pocket 327, passages 326 and 324 and port 325 into the induction passage of the carburetor. The delivery of enrichment fuel will continue until the actuator 352 is returned to the position shown in the drawings.

The needle valve 353 may be adjusted with a screwdriver inserted in the open end of hollow extension 351. If the needle valve 353 is of synthetic resinous material, having a significantly greater coefficient of expansion than the valve member 344, it can provide a measure of automatic temperature compensation. Since the needle valve will expand more than valve member 344 as the temperature rises, the needle valve will approach closer to throttling orifice 346, thus reducing the amount of enrichment fuel supplied at higher temperatures.

While various preferred embodiments of the invention have been disclosed above, it will be appreciated that many variations can be made without departing from the spirit of the following claims.

What is claimed is:

1. In a carburetor comprising a body defining an induction passage having upstream air valve means and downstream throttle means therein, the air valve means providing for delivery of fuel to the induction passage and having an air valve member normally biased towards a closed position but moveable between said closed position and an open position in response to varying air flow through the induction passage, the improvement which comprises: the throttle means being mounted on shaft means extending along at least one side of the induction passage, and including an upstream surface portion extending from the shaft means towards the opposite side of the induction passage, and being inclined downstream when viewed in its closed position; and orifices being formed in the surface of the air valve member for discharging fuel into the induction passage, the orifices communicating with connecting means for connecting the orifices to a source of fuel.

2. A carburetor according to claim 1, wherein the fuel discharge orifices of said air valve member are formed in an edge past which air flows in said induction passage.

3. A carburetor according to claim 2, wherein said air valve member is formed in two parts, in at least one of which is formed grooves, the parts being mateable with the grooves positioned to define the connecting means, a manifold means extending within the air valve member along and adjacent said edge, and the discharge orifices.

4. A carburetor according to claim 1, wherein said connecting means is lined with conduit.

5. A carburetor according to claim 1, wherein a plurality of small grooves is distributed at spaced intervals across said edge of said air valve member generally in the direction of air flow past said air valve member.

6. A carburetor according to claim 1, wherein biasing means are positioned for coupling an upstream surface of said air valve member to a support above said air valve member.

7. A carburetor according to claim 6, wherein said biasing means comprises a moveable member and a tension rod connected between a first pivot on the moveable member and a second pivot on the air valve member.

8. A carburetor according to claim 7, wherein said moveable member is a reciprocable member slidably mounted on a post extending upstream of said air valve member.

9. A carburetor according to claim 7, wherein when the carburetor is viewed with said moveable member positioned for vertical movement, the relative orientation of the moveable member to said pivots is such as to cause said tension rod to swing from an inclination on one side of vertical, through vertical, to an opposite inclination to the vertical as said air valve means swings from its closed to its full open position.

10. A carburetor according to claim 1 including an air valve positioner selectively movable between first and second positions for selectively preventing or not preventing the air valve member from closing further than a predetermined partly open position.

11. A carburetor according to claim 10, wherein said air valve positioner includes a withdrawable obstruction member moveable between said first and second positions.

12. A carburetor according to claim 11, wherein biasing means are positioned for coupling an upstream surface of said air valve member to a support above said air valve member, with said obstruction member being positioned adjacent said biasing means to obstruct said air valve means indirectly by preventing said biasing means from closing said air valve means further than said predetermined position.

13. A carburetor according to claim 1 including fuel metering means having a fuel pick-up arm and a metering ramp, said fuel metering means being operable for metering the delivery of fuel to said air valve member in response to the opening and closing of said air valve member.

14. A carburetor according to claim 13, wherein said fuel pick-up arm is mounted on a shaft, the metering ramp is supported by hanger means and the hanger means is carried on and suspended from said shaft.

15. A carburetor according to claim 13, wherein said fuel metering means includes a fuel chamber having a wall which divides it from the induction passage, and the metering ramp is supported in the fuel chamber by hanger means spaced inwardly from said wall to provide for circulation of fuel between said wall and said hanger means.

16. A carburetor according to claim 13, wherein said fuel metering means comprises a fuel chamber, said air valve member being supported for rotation upon a hollow shaft extending through a wall of the induction passage to said fuel chamber, and said fuel metering means further comprises a fuel pick-up arm secured to the hollow shaft within said fuel chamber, said fuel pick up arm including a hollow bore having an inlet at one end of the fuel pick-up arm adjacent a metering ramp.

17. A carburetor according to claim 16, wherein said fuel pick-up arm includes a bore having at one end thereof an inlet adjacent the metering ramp which includes a metering edge, ball valve means at the one end of the bore, means for maintaining the ball valve means in contact with the ramp and means for laterally confining said ball valve means during movement of said fuel pick-up arm relative to said ramp, whereby fuel may be metered by movement of the ball valve means relative to said metering edge.

18. A carburetor according to claim 1, including a fuel enrichment system having a source of fuel, a fuel enrichment port in the induction passage, and conduit means extending from said source of fuel to said port and having a control valve operable to selectively connect the fuel enrichment port with the source of fuel or with a vent, said source of fuel being a float chamber for containing a supply of fuel with a gas space above the fuel, and said vent being a passage communicating between the control valve and the gas space.

19. A carburetor according to claim 1, wherein said throttle means has a downstream surface portion which is arcuate when viewed in vertical cross section, with a substantial portion of said downstream surface portion being at a uniform radial distance from the axis of rotation of said throttle means.

20. A carburetor according to claim 19 or claim 22, wherein said carburetor body supports sealing means positioned between the throttle means and adjacent portions of the body.

21. A carburetor according to claim 20, wherein said carburetor body includes groove means formed adjacent said throttle means, with said sealing means being positioned and held in said groove means.

22. A carburetor according to claim 1, wherein said throttle means has parallel ends which are perpendicular to its axis of rotation.

23. A carburetor according to claim 22, wherein said throttle means includes a back surface portion which is recessed in and surrounded by the downstream surface portion and ends.

24. A carburetor according to claim 23, wherein communication exists between the back surface portion and the induction passage.

25. A carburetor according to claim 19 or claim 22, wherein said throttle means includes a back surface portion which has an area approximately equal to that of the upstream surface portion.

26. A carburetor according to claim 25, wherein communication exists between the back surface portion and the induction passage.

27. A carburetor according to claim 1, wherein said throttle means includes an arcuate downstream surface portion which meets with the upstream surface portion along an edge past which air flows through the induction passage, and said throttle means includes a lip extending along said edge for inhibiting attachment of fuel to the throttle member and for preventing fuel from flowing down the arcuate downstream surface portion.

28. A carburetor according to claim 27, wherein said lip takes the form of an interruption of the downstream surface portion.

29. A carburetor according to claim 27, wherein the downstream surface portion includes an undercut on the downstream side of said lip.

30. A carburetor according to claim 27, wherein said lip has an outer tip which is substantially on or within the projected arc of the downstream surface portion for balancing forces which tend to spontaneously open said throttle means.

31. A carburetor according to claim 27, wherein said lip has an upstream edge which is curved for reducing noise by reducing or eliminating pulsation and turbulence in the intake charge as it passes the edge of said throttle means.

32. A carburetor according to claim 1, wherein said air valve member and throttle means are each mounted on separate shafts, with the shaft for said throttle means being closer to a reference line located substantially centrally of the induction passage adjacent said air valve member and throttle means than the shaft for the air valve member.

33. A carburetor according to claim 32, wherein said air valve member downstream surface includes a concave bend which extends across the shaft for the throttle means, and wherein said air valve member is inclined downstream in the induction passage, at least when said air valve member and throttle means are open.

34. A carburetor according to claim 32, wherein said air valve member includes a portion which overlaps a part of the upstream surface portion of the throttle means at least when the air valve member and throttle means are open.

35. A carburetor according to claim 38, wherein said portion of the air valve member assumes a position against said throttle means upstream surface portion when said throttle means and air valve member are wide open.

36. A carburetor according to claim 1, wherein said air valve member includes upstream and downstream surfaces, extending from a boss, at which said air valve means is mounted for rotation on air valve shaft means, to a tip of said air valve means which is moveable in an arc as the air valve means rotates on said air valve shaft means, said throttle means upstream surface portion extending from a boss at which the throttle means is mounted for rotation on throttle shaft means, said bosses being secured in the carburetor with a clearance between them, said clearance being sufficiently small to direct the main flow of air around the tip of the air valve means rather than between the bosses, but of sufficient size to cause some air to pass between the bosses and over the upstream surface portion of the throttle means for purging fuel from said upstream surface portion.

37. A carburetor according to claim 1, wherein said air valve means comprises a plurality of air valve members, the members being coupled to operate synchronously by biasing means which continuously urge the members towards their closed positions.

38. A carburetor according to claim 37, wherein said biasing means includes a moveable member to which each of the air valve members is connected.

39. A carburetor according to claim 1, wherein said air valve means comprises a plurality of air valve members mounted on individual air valve shafts, the respective air valve shafts being located at the periphery of an imaginary envelope defining the induction passage.

40. A carburetor according to claim 39, wherein each air valve member is mounted for pivotal movement on its own individual shaft.

41. A carburetor according to claim 39 including biasing means for substantially synchronizing the movements of said air valve members.

42. A carburetor according to claim 41, wherein said biasing means includes a moveable member to which each of said air valve members is connected for movement in unison with one another.

43. A carburetor according to claim 1, wherein said throttle means takes the form of a plurality of throttle members mounted on individual throttle shafts, said respective throttle shafts being located at the periphery of an imaginary envelope defining the induction passage.

44. A carburetor according to claim 43, wherein each throttle member is mounted for pivotal movement on its own individual shaft.

45. A carburetor according to claim 43 including means for substantially synchronizing the movements of said throttle members.

46. A carburetor according to claim 45, wherein the means for synchronizing the throttle members comprises a rotation-reversing lever linkage, said linkage including a first lever arm connected with a first shaft-mounted throttle member, a second lever arm connected with a second shaft-mounted throttle member and a connecting link connected between said levers and positioned for rotating the second throttle member in the opposite direction when the first throttle member is rotated in a given direction.

47. A carburetor according to claim 1, wherein said throttle means comprises a throttle member formed of synthetic resin.

48. A carburetor according to claim 1, wherein said induction passage is divided into a plurality of throats, wherein separate air valve means and throttle means are provided for each throat.

49. A carburetor according to claim 48, wherein said induction passage is divided by a dividing member arranged such that the respective throttle means upstream surface portions terminate in lips which are located at or adjacent the dividing member when said throttle means are in the closed position.

50. A carburetor according to claim 49, wherein a fuel enrichment port is positioned in said dividing member.

51. A carburetor according to claim 1, wherein said air valve member includes upstream and downstream surfaces and a tip which is moveable in an arc upon rotation of said air valve member upon air valve shaft means, the downstream surface of said air valve member and the upstream surface portion of said throttle means defining between them a region of the induction passage, the length of said region as measured in the general direction of flow through the induction passage being less than the width of said region measured parallel to the rotational axis of the air valve member, said orifices being located at the tip of the air valve member and positioned for projecting the fuel in a direction away from said air valve shaft means, and said air valve member and throttle means being positioned sufficiently to close to one another, when in closed position, for causing said air valve member, when in wide open position, to overlap at least a portion of the throttle means upstream surface portion.

52. A carburetor according to claim 51, wherein an additional air entry from the carburetor air inlet into said region is spaced inwardly in said region from said tip, is in communication through said region with the main flow of air around the tip of the air valve member, and is of sufficient size to cause some air from said inlet to pass through said additional air entry into said region and along the upstream surface portion of said throttle means for purging fuel from said upstream surface portion.

53. A carburetor according to claim 52, wherein said air valve member upstream and downstream surfaces extend from a boss at which said air valve member is mounted for rotation on said air valve shaft means, said throttle means upper surface portion extends from a boss at which the throttle means is mounted for rotation on a throttle shaft means and said additional air entry of said region is defined by a clearance between said bosses.

54. A carburetor according to claim 1, wherein said induction passage is divided into a plurality of throats having a plurality of air valve members with separate fuel metering means connected thereto, the separate fuel metering means being connected with sources of supply for different fuels.

55. A carburetor according to claim 1, wherein said induction passage is divided into a plurality of throats, separate air valve members and throttle members are provided in each throat, said air valve members include upstream and downstream surfaces and tips which are moveable in arcs upon rotation of said air valve members upon air valve shaft means, the downstream surfaces of said air valve members and the upstream surface portions of said throttle members defining between them regions of the induction passage, the length of these regions measured in the general direction of flow through the induction passage being less than the widths of said regions, said orifices being located at the tips of the air valve members and positioned for projecting the fuel in directions away from said air valve shaft means, and said air valve members and throttle members being positioned sufficiently close to one another, when in closed position, for causing said air valve members, when in wide open position, to overlap portions of the throttle members' upper surface portions.

56. A carburetor according to claim 55, wherein said induction passage is divided by a dividing member arranged such that the respective throttle member upstream surface portions terminate in lips which are located at or adjacent the dividing member when said throttle members are in the closed position.

* * * * *